United States Patent [19]

Saitoh et al.

[11] Patent Number: 4,592,982

[45] Date of Patent: Jun. 3, 1986

[54] PHOTOCONDUCTIVE MEMBER OF LAYER OF A-GE, A-SI INCREASING (O) AND LAYER OF A-SI(C) OR (N)

[75] Inventors: Keishi Saitoh, Ibaraki; Yukihiko Ohnuki, Kawasaki; Shigeru Ohno, Yokohama, all of Japan

[73] Assignee: Canon Kabushiki Kaisha, Tokyo, Japan

[21] Appl. No.: 665,981

[22] Filed: Oct. 29, 1984

[30] Foreign Application Priority Data

Nov. 4, 1983 [JP] Japan ..... 58-207775
Dec. 13, 1983 [JP] Japan ..... 58-234790

[51] Int. Cl.[4] ..... G03G 5/082

[52] U.S. Cl. ..... 430/57; 430/84; 430/95

[58] Field of Search ..... 430/57, 84, 85, 86, 430/95

[56] References Cited

U.S. PATENT DOCUMENTS 4,490,450 12/1984 Shimizu et al. ..... 430/84
4,491,626 1/1985 Kawamura et al. ..... 430/57
4,495,262 1/1985 Matsuzaki et al. ..... 430/84

*Primary Examiner*—John L. Goodrow
*Attorney, Agent, or Firm*—Fitzpatrick, Cella, Harper & Scinto

[57] ABSTRACT

A photoconductive member is provided which has a substrate for photoconductive member, and a light-receiving layer comprising (1) a first layer with a layer constitution in which a first layer region (G) comprising an amorphous material containing germanium atoms and a second layer region (S) exhibiting photoconductivity comprising an amorphous material containing silicon atoms are successively provided on said substrate from the aforesaid substrate side, and (2) a second layer comprising an amorphous material containing silicon atoms and at least one of carbon atoms and nitrogen atoms, said first layer having a layer region (O) containing oxygen atoms, wherein the depth profile of oxygen atoms in the layer thickness direction in said layer region (O) is increased smoothly and continuously toward the upper end surface of the first layer.

32 Claims, 19 Drawing Figures

PHOTOCONDUCTIVE MEMBER OF LAYER OF A-GE, A-SI INCREASING (O) AND LAYER OF A-SI(C) OR (N)

BACKGROUND OF THE INVENTION

1. Field of the Invention

This invention relates to a photoconductive member having sensitivity to electromagnetic waves such as light [herein used in a broad sense, including ultraviolet rays, visible light, infrared rays, X-rays, gamma-rays, and the like].

2. Description of the Prior Art

Photoconductive materials, which constitute photoconductive layers in solid state image pickup devices, image forming members for electrophotography in the field of image formation, or manuscript reading devices and the like, are required to have a high sensitivity, a high SN ratio [photocurrent ($I_p$)/dark current ($I_d$)], spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. Particularly, in case of an image forming member for electrophotography to be assembled in an electrophotographic device to be used in an office as office apparatus, the aforesaid harmless characteristic is very important.

From the standpoint as mentioned above, amorphous silicon [hereinafter referred to as a-Si] has recently attracted attention as a photoconductive material. For example, German OLS Nos. 2746967 and 2855718 disclose applications of a-Si for use in image forming members for electrophotography, and German OLS No. 2933411 discloses an application of a-Si for use in a photoelectric transducing reading device.

However, under the present situation, the photoconductive member of the prior art having photoconductive layers constituted of a-Si are further required to be improved in a balance of overall characteristics including electrical, optical and photoconductive characteristics such as dark resistance value, photosensitivity and response to light, etc., and environmental characteristics during use such as humidity resistance, and further stability with the lapse of time.

For instance, when the above photoconductive member is applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so called ghost phenomenon wherein residual images are formed.

Further, a-Si has a relatively smaller coefficient or absorption of the light on the longer wavelength side in the visible light region as compared with that on the shorter wavelength side. Accordingly, in matching to the semiconductor laser practically applied at the present time, the light on the longer wavelength side cannot effectively be utilized, when employing a halogen lamp or a fluorescent lamp as the light source. Thus, various points remain to be improved.

On the other hand, when the light irradiated is not sufficiently absorbed in the photoconductive layer, but the amount of the light reaching the substrate is increased, interference due to multiple reflection may occur in the photoconductive layer to become a cause for "unfocused" image, in the case when the substrate itself has a high reflectance against the light transmitted through the photoconductive layer.

This effect will be increased, if the irradiated spot is made smaller for the purpose of enhancing resolution, thus posing a great problem in the case of using a semiconductor laser as the light source.

Accordingly, while attempting to improve the characteristics of a-Si material per se on one hand, it is also required to make efforts to overcome all the problems as mentioned above in designing of the photoconductive member on the other hand.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. It has now been found that a photoconductive member having a layer constitution comprising a light receiving layer exhibiting photoconductivity, which comprises an amorphous material containing silicon atoms as the matrix (a-Si), especially an amorphous material containing at least one of hydrogen atom (H) and halogen atom (X) in a matrix of silicon atoms such as so called hydrogenated amorphous silicon, halogenated amorphous silicon, or halogen-containing hydrogenated amorphous silicon [hereinafter referred to comprehensively as a-Si(H,X)], said photoconductive member being prepared by designing so as to have specific structure as hereinafter described, not only exhibits practically extremely excellent characteristics but also surpass the photoconductive members of the prior art in substantially all respects, especially having markedly excellent characteristics as a photoconductive member for electrophotography and also excellent absorption spectrum characteristics on the longer wavelength side.

SUMMARY OF THE INVENTION

A primary object of the present invention is to provide a photoconductive member having electrical, optical and photoconductive characteristics which are constantly stable and all-environment type with virtually no dependence on the environments under use, which member is markedly excellent in photosensitive characteristics on the longer wavelength side and light fagigue resistance and also excellent in durability without causing deterioration phenomenon when used repeatedly, exhibiting no or substantially no residual potential observed.

Another object of the present invention is to provide a photoconductive member which is high in photosensitivity throughout the whole visible light region, particularly excellent in matching to a semiconductor laser as well as in interference inhibition, and also rapid in response to light.

Still another object of the present invention is to provide a photoconductive member having sufficient charge retentivity during charging treatment for formation of electrostatic images to the extent such that a conventional electrophotographic method can be very effectively applied when it is provided for use as an image forming member for electrophotography.

Further, still another object of the present invention is to provide a photoconductive member for electrophotography, which can easily provide an image of high quality which is high in density, clear in halftone and high in resolution.

Still another object of the present invention is to provide a photoconductive member having high photosensitivity any high SN ratio characteristics.

According to the present invention, there is provided a photoconductive member, having a substrate for photoconductive member, and a light receiving layer comprising (1) a first layer with a layer constitution in which a first layer region (G) comprising an amorphous material containing germanium atoms and a second layer region (S) exhibiting photoconductivity comprising an amorphous material containing silicon atoms are successively provided on said substrate from the aforesaid substrate side, and (2) a second layer comprising an amorphous material containing silicon atoms and at least one of carbon atoms and nitrogen atoms, said first layer having a layer region (O) containing oxygen atoms, wherein the depth profile of oxygen atoms in the layer thickness direction in said layer region (O) is increased smoothly and continuously toward the upper end surface of the first layer.

DETAILED DESCRIPTION OF THE PREFERRED EMBODIMENTS

Figure 1:
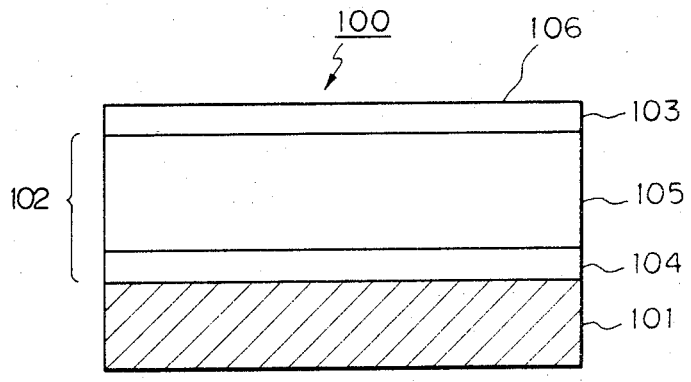
FIG. 1 shows a schematic sectional view for illustration of the layer constitution of the photoconductive member according to the present invention.

Referring now to the drawings, the photoconductive members according to the present invention are to be described in detail below.

FIG. 1 shows a schematic sectional view for illustration of the layer constitution of a first embodiment of the photoconductive member of this invention.

The photoconductive member 100 as shown in FIG. 1 is constituted of a light receiving layer 102 formed on a substrate 101 for photoconductive member, said light receiving layer 102 having a free surface 105 on one end surface.

The light receiving layer 102 is constituted of a first layer region (G) 104 consisting of germanium atoms and, if desired, at least one of silicon atoms, hydrogen atoms and halogen atoms (hereinafter abbreviated as "a-Ge(Si,H,X)" and a second layer region (S) 105 having photoconductivity laminated successively from the substrate side 101.

The germanium atoms contained in the first layer region (G) 104 may be contained uniformly throughout the layer region (G) 104, or alternatively with ununiform depth profile in the layer thickness direction. However, in either case, in the plane direction parallel to the surface, they are required to be contained evenly with a uniform distribution within the plane direction for uniformizing the characteristics. In particular, the germanium atoms are contained in the first layer region (G) 104 in such a manner that they are contained throughout the layer thickness direction of the first layer (I) 102 and in a distribution more enriched toward the substrate side 101 with respect to the side opposite to the side where the substrate is provided (the interface side 105 of the first layer 102 facing the second layer II) or in a distribution opposite to such a distribution.

In the photoconductive member of the present invention, the distribution of germanium atoms contained in the first layer region (G) as described above should desirably take such a profile in the layer thickness direction, while a uniform distribution within the plane parallel to the surface of the substrate.

In the present invention, in the second layer region (S) provided on the first layer region (G), no germanium atom is contained, and by forming the first layer (I) to such a layer constitution, it is possible to give a photoconductive member which is excellent in photosensitivity to the light over the entire wavelength region from relatively shorter wavelength to relatively longer wavelength including visible light region.

Also, in a preferred embodiment, since the distribution of germanium atoms in the first layer region (G) is varied such that germanium atoms are distributed continuously over all the layer region with the content C of germanium atoms in the layer thickness direction being reduced from the substrate side to the second layer region (S), affinity between the first layer region (G) and the second layer region (S) is excellent. Also, as described hereinafter, by increasing the content C of germanium atoms at the end portion on the substrate side extremely great, the light on the longer wavelength side which cannot substantially be absorbed by the second layer region (S) can be absorbed in the first layer region (G) substantially completely, when employing a semiconductor laser, whereby interference by reflection from the substrate surface can be prevented.

FIGS. 2 through 10 show typical examples of ununiform distribution in the direction of layer thickness of germanium atoms contained in the first layer region (G) of the photoconductive member in the present invention.

In FIGS. 2 through 10, the abscissa indicates the content C of germanium atoms and the ordinate the layer thickness of the first layer region (G), $t_B$ showing the position of the end surface of the first layer region (G) on the substrate side and $t_T$ the position of the end surface of the first layer region (G) on the side opposite to the substrate side. That is, layer formation of the first layer region (G) containing germanium atoms proceeds from the $t_B$ side toward the $t_T$ side.

Figure 2:
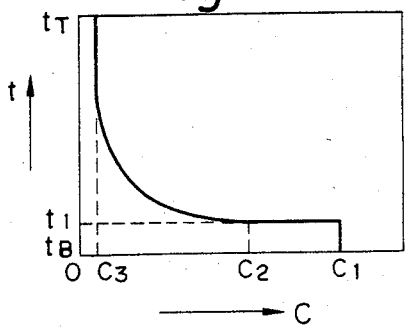
FIGS. 2 to 10 each shows a schematic illustration of the depth profiles of germanium in the first layer (I)

In FIG. 2, there is shown a first typical embodiment of the depth profile of germanium atoms in the layer thickness direction contained in the first layer region (G).

In the embodiment as shown in FIG. 2, from the interface position $t_B$ at which the surface, on which the first layer region (G) containing germanium atoms is to be formed, is contacted with the surface of said layer region (G) to the position $t_1$, germanium atoms are contained in the first layer region (G) as formed, while the content C of germanium atoms taking a constant value of $C_1$, which content being gradually decreased from the content $C_2$ continuously from the position $t_1$ to the interface position $t_T$. At the interface position $t_T$, the content C of germanium atoms is made $C_3$.

Figure 3:
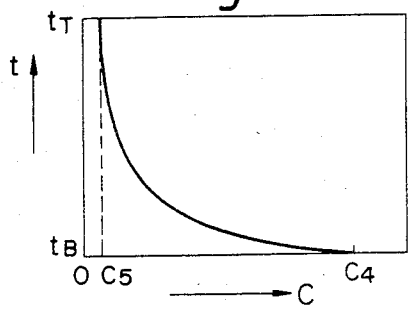

In the embodiment shown in FIG. 3, the content C of germanium atoms contained is decreased gradually and continuously from the position $t_B$ to the position $t_T$ from the content $C_4$ until it becomes the content $C_5$ at the position $t_T$.

Figure 4:
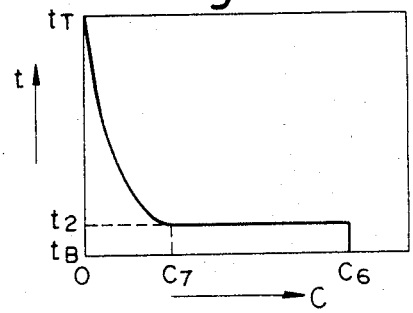

In case of FIG. 4, the content C of germanium atoms is made constant as $C_6$, gradually decreased continuously from the position $t_2$ to the position $t_T$, and the content C is made substantially zero at the position $t_T$ (substantially zero herein means the content less than the detectable limit).

Figure 5:
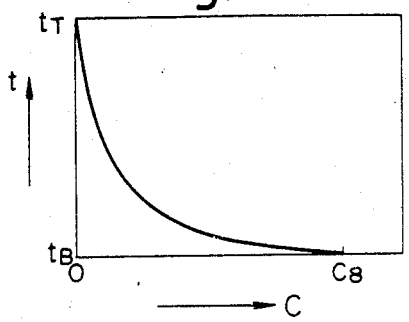

In case of FIG. 5, the content C of germanium atoms are decreased gradually and continuously from the position $t_B$ to the position $t_T$ from the content $C_8$, until it is made substantially zero at the position $t_T$.

Figure 6:
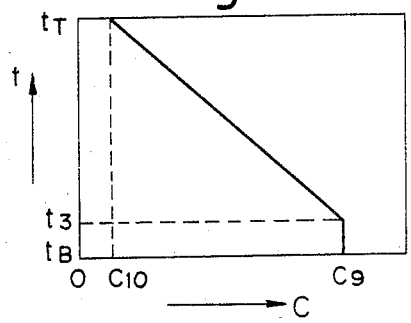

In the embodiment shown in FIG. 6, the content C of germanium atoms is constantly $C_9$ between the position $t_B$ and the position $t_3$, and it is made $C_{10}$ at the position $t_T$. Between the position $t_3$ and the position $t_T$, the content is reduced as a first order function from the position $t_3$ to the position $t_T$.

Figure 7:
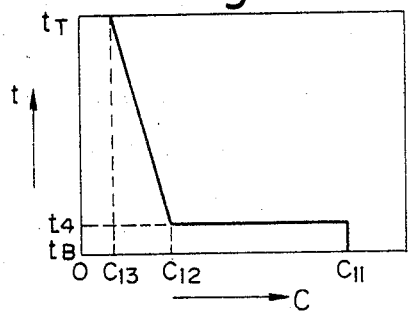

In the embodiment shown in FIG. 7, there is formed a depth profile such that the content C take a constant value of $C_{11}$ from the position $t_B$ to the position $t_4$, and is decreased as a first order function from the content $C_{12}$ to the content $C_{13}$ from the position $t_4$ to the position $t_T$.

Figure 8:
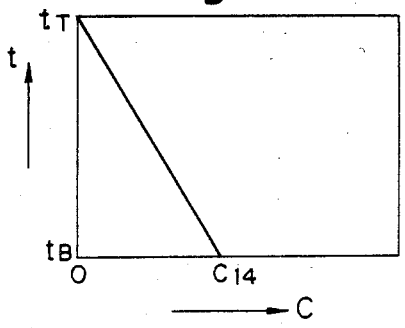

In the embodiment shown in FIG. 8, the content C of germanium atoms is decreased as a first order function from the content $C_{14}$ to zero from the position $t_B$ to the position $t_T$.

Figure 9:
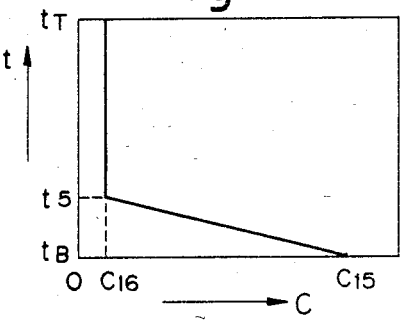

In FIG. 9, there is shown an embodiment, where the content C of germanium atoms is decreased as a first order function from the content $C_{15}$ to the content $C_{16}$ from the position $t_B$ to $t_5$ and made constantly at the content $C_{16}$ between the position $t_5$ and $t_T$.

Figure 10:
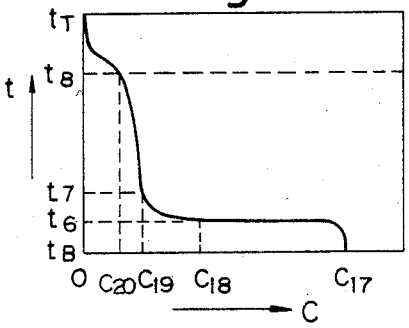

In the embodiment shown in FIG. 10, the content C of germanium atoms is at the content $C_{17}$ at the position $t_B$, which content $C_{17}$ is initially decreased gradually and abruptly near the position $t_6$ to the position $t_6$, until it is made the content $C_{18}$ at the position $t_6$.

Between the position $t_6$ and the position $t_7$, the content C is initially decreased abruptly and thereafter gradually, until it is made the content $C_{19}$ at the position $t_7$. Between the position $t_7$ and the position $t_8$, the content C is decreased very gradually to the content $C_{20}$ at the position $t_8$. Between the position $t_8$ and the position $t_T$, the content is decreased along the curve having a shape as shown in the Figure from the content $C_{20}$ to substantially zero.

As described above about some typical examples of depth profiles of germanium atoms contained in the first layer region (G) in the direction of the layer thickness by referring to FIGS. 2 through 10, as a preferable embodiment in the present invention, the first layer region (G) is provided desirably in a depth profile so as to have a portion enriched in content C of germanium atoms on the substrate side and a portion depleted in content C of germanium atoms to considerably lower than that of the substrate side on the interface $t_T$ side.

The first layer region (G) constituting the first layer (I) of the photoconductive member in the present invention may preferably be provided so as to have a localized region (A) containing germanium atoms at a relatively higher content on the substrate side, or contrariwise on the free surface side.

For example, the localized region (A), as explained in terms of the symbols shown in FIG. 2 through FIG. 10, may be desirably provided within 5μ from the interface position $t_B$.

In the present invention, the above localized region (A) may be made to be identical with the whole layer region ($L_T$) up to the depth of 5μ thickness from the interface position $t_B$, or alternatively a part of the layer region ($L_T$).

It may suitably be determined depending on the characteristics required for the first layer (I) to be formed, whether the localized region (A) is made a part or whole of the layer region ($L_T$).

The localized region (A) may preferably be formed according to such a layer formation that the maximum Cmax of the content of germanium atoms in a distribution in the layer thickness direction (depth profile values) may preferably be 1000 atomic ppm or more, more preferably 5000 atomic ppm or more, most preferably $1\times10^4$ atomic ppm or more based on the sum of germanium atoms and silicon atoms.

That is, according to the present invention, the layer region containing germanium atoms is formed so that the maximum value Cmax of the depth profile may exist within a layer thickness of 5μ from the substrate side (the layer region within 5μ thickness from $t_B$).

In the present invention, the content of germanium atoms in the first layer region (G) containing germanium atoms, which may suitably be determined as desired so as to achieve effectively the objects of the present invention, may preferably be 1 to $10\times10^5$ atomic ppm, more preferably 100 to $9.5\times10^5$ atomic ppm, most preferably 500 to $8\times10^5$ atomic ppm.

In the photoconductive member of the present invention, the layer thickness of the first layer region (G) and the thickness of the second layer region (S) are one of important factors for accomplishing effectively the object of the present invention and therefore sufficient care should be paid in designing of the photoconductive member so that desirable characteristics may be imparted to the photoconductive member formed.

In the present invention, the layer thickness $T_B$ of the first layer region (G) may preferably be 30 Å to 50μ, more preferably 40 Å to 40μ, most preferably 50 Å to 30μ.

On the other hand, the layer thickness T of the second layer region (S) may be preferably 0.5 to 90μ, more preferably 1 to 80μ, most preferably 2 to 50μ.

The sum of the layer thickness $T_B$ of the first layer region (G) and the layer thickness T of the second layer region (S), namely ($T_B+T$) may be suitably determined as desired in designing of the layers of the photoconductive member, based on the mutual organic relationship between the characteristics required for both layer regions and the characteristics required for the whole first layer (I).

In the photoconductive member of the present invention, the numerical range for the above ($T_B+T$) may generally be from 1 to 100μ, preferably 1 to 80μ, most preferably 2 to 50μ.

In a more preferred emboidment of the present invention, it is preferred to select the numerical values for respective thicknesses $T_B$ and T as mentioned above so that the relation of $T_B/T\leqq1$ may be satisfied.

More preferably, in selection of the numerical values for the thicknesses $T_B$ and T in the above case, the values of $T_B$ and T should preferably be determined so that the relation $T_B/T\leqq0.9$, most preferably, $T_B/T\leqq0.8$, may be satisfied.

In the present invention, when the content of germanium atoms in the first layer region (G) is $1\times10^5$ atomic ppm or more, the layer thickness $T_B$ of the first layer region (G) should desirably be made as thin as possible, preferably 30μ or less, more preferably 25μ or less, most preferably 20μ or less.

In the present invention, illustrative of halogen atoms (X), which may optionally be incorporated in the first layer region (G) and/or the second layer region (S) constituting the first layer (I), are fluorine, chlorine, bromine and iodine, particularly preferably fluorine and chlorine.

In the photoconductive member of the present invention, for the purpose of improvements to higher photosensitivity, higher dark resistance and, further, improvement of adhesion between the substrate and the light receiving layer, a layer region (O) containing oxygen atoms is provided in the first layer (I). The oxygen atoms contained in the first layer (I) may be contained either evenly throughout the whole layer region of the first layer (I) or locally only in a part of the layer region of the first layer (I).

In the present invention, the distribution of oxygen atoms in the layer region (O) may be such that the content C(O) is uniform within the plane parallel to the surface of the substrate, but the depth profile C(O) in the layer thickness direction is ununiform similarly as the depth profile of the germanium atoms as described with reference to FIGS. 2 to 10.

FIGS. 11 through 16 show typical examples of distributions of oxygen atoms as a whole within the first layer (I). In these Figures, the abscissa indicates the distribution concentration of the oxygen atoms in the layer thickness direction and the ordinate the layer thickness of the first layer (I) exhibiting photoconductivity, $t_B$ showing the position of the end surface (lower end surface) of the first layer (I) on the substrate side and $t_T$ the position of the end surface (upper end surface) on the side opposite to the substrate side. That is, layer formation of the first layer (I) proceeds from the $t_B$ side toward the $t_T$ side.

Figure 11:
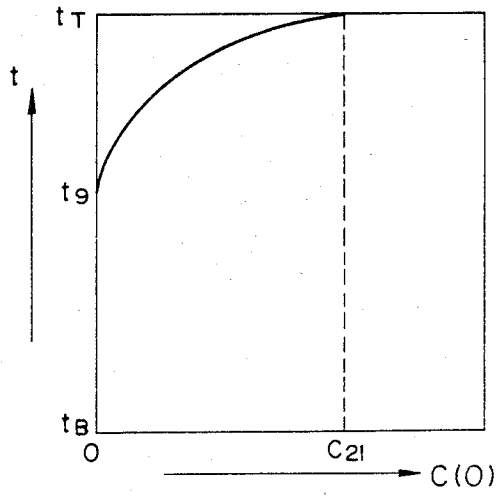
FIGS. 11 to 16 each shows a schematic illustration of the depth profile of oxygen atoms in the first layer (I)

In the embodiment as shown in FIG. 11, no oxygen atom is contained in the layer region from the position $t_B$ to the position $t_9$, the oxygen atoms are contained in the layer region from $t_9$ to the position $t_T$ of the interface between the first layer (I) and the second layer (II), while the content C(O) of oxygen atoms being gradually increased continuously from the position $t_9$ toward the $t_T$ side. At the position $t_T$, the content C(O) of oxygen atoms $C_{21}$.

Figure 12:
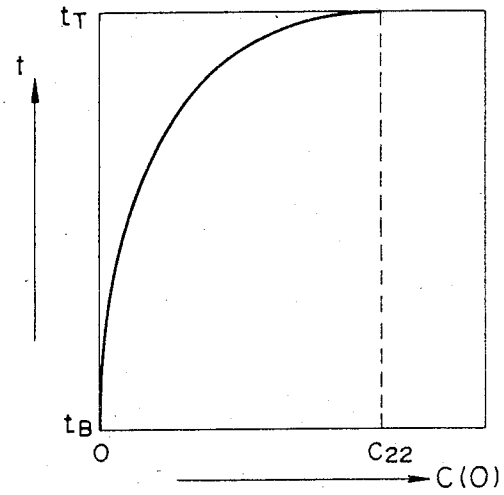

In the embodiment shown in FIG. 12, oxygen atoms are contained throughout the whole layer region of the first layer (I) from the position $t_B$ to the free surface $t_T$, with the content C(O) of oxygen atoms being monotonously increased gradually and smoothly up to $t_T$, until it becomes the content $C_{22}$ at the position $t_T$.

Figure 13:
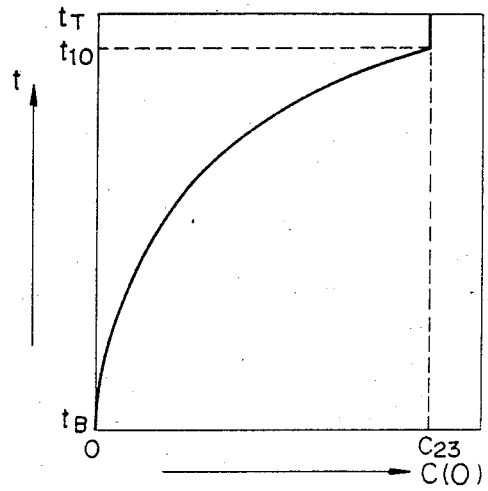

In the embodiment shown in FIG. 13, the content C(O) of oxygen atoms is increased monotonously from 0 to $C_{23}$ in the layer region from the position $t_B$ to $t_{10}$, while the content C(O) of oxygen atoms being kept constant at $C_{23}$ in the layer region from the position $t_{10}$ to $t_T$.

Figure 14:
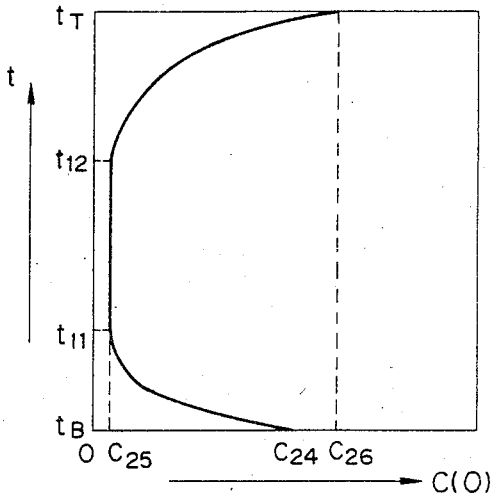

In the embodiment shown in FIG. 14, the content C(O) of oxygen atoms is gently decreased from $C_{24}$ to $C_{25}$ in the layer region from the position $t_B$ to $t_{11}$, the content C(O) is constantly $C_{25}$ in the layer region from the position $t_{11}$ to $t_{12}$, and the content C(O) of oxygen atoms continuously increased from $C_{25}$ to $C_{26}$ in the layer region from the position $t_{12}$ to $t_T$.

Figure 15:
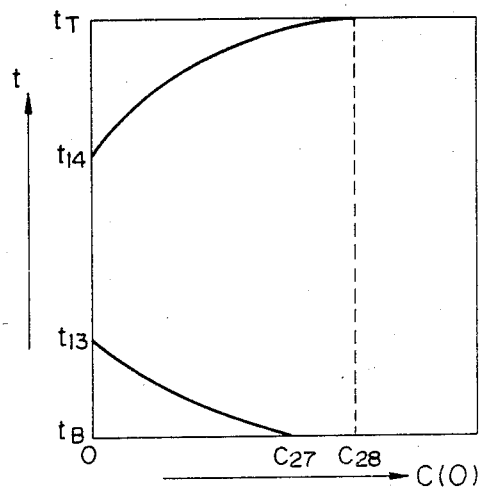

In the embodiment shown in FIG. 15, there is shown the case of having two layer regions (O) containing oxygen atoms. More specifically, in the layer region from the position $t_B$ to $t_{13}$, the content C(O) of oxygen atoms is decreased from $C_{27}$ to 0, no oxygen atom is contained in the layer region from the position $t_{13}$ to $t_{14}$, and the content C(O) is monotonously increased from 0 to $C_{28}$.

Figure 16:
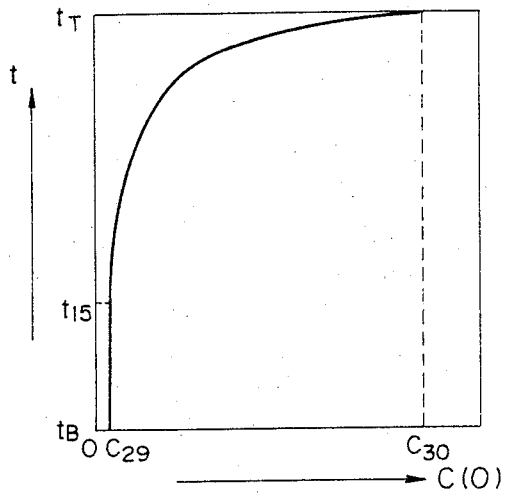

In the case of FIG. 16, the content C(O) of oxygen atoms is constantly $C_{29}$ in the layer region from the position $t_B$ to $t_{15}$ while the content in the layer region from the position $t_{15}$ to $t_T$ is slowly increased initially and thereafter increased abruptly until it reaches $C_{30}$ at $t_T$.

In the present invention, the layer region (O) containing oxygen atoms provided in the first layer (I), when improvements of photosensitivity and dark resistance are primarily intended, is provided so as to comprise the whole layer region of the first layer (I), while it is provided in the vicinity of the interface of the free surface side for prevention of injection of charges from the free surface of the light receiving layer, or it is provided so as to occupy the layer region (E) in the end portion on the substrate side, when reinforcement of adhesion between the substrate and the light receiving layer is primarily intended.

In the first case, the content of oxygen atoms in the layer region (O) may be desirably made relatively smaller in order to maintain high photosensitivity, while in the second case, the content is increased in the vicinity of the surface for prevention of injection of charges from the free surface of the light receiving layer, and in the third case, the content is made relatively large for ensuring reinforcement of adhesion with the substrate.

Also, for the purpose of accomplishing all of the three cases at the same time, oxygen atoms may be distributed in the layer region (O) so that they may be distributed in a relatively higher content on the substrate side, in a relatively lower content in the middle of the light receiving layer, with increased amount of oxygen atoms in the interface layer region on the free surface side of the light receiving layer.

In the present invention, the content of oxygen atoms to be contained in the layer region (O) provided in the first layer (I) may be suitably selected depending on the characteristics required for the layer region (O) per se or, when said layer region (O) is provided in direct contact with the substrate, depending on the organic relationship such as the relation with the characteristics at the contacted interface with said substrate and others.

When, another layer region is to be provided in direct contact with said layer region (O), the content of oxygen atoms may be suitably selected also with considerations about the characteristics of said another layer region and the relation with the characteristics of the contacted interface with said another layer region.

The content of oxygen atoms in the layer region (O), which may suitably be determined as desired depending on the characteristics required for the photoconductive member to be formed, may be preferably 0.001 to 50 atomic %, more preferably 0.002 to 40 atomic %, most preferably 0.003 to 30 atomic %.

In the present invention, when the layer region (O) comprises the whole region of the first layer (I) or when, although it does not comprise the whole layer region, the layer thickness $T_o$ of the layer region (O) is sufficiently large relative to the layer thickness T of the first layer (I), the upper limit of the content of oxygen atoms in the layer region (O) should desirably be sufficiently smaller than the aforesaid value.

In the case of the present invention, in such a case when the ratio of the layer thickness $T_o$ of the layer region (O) relative to the layer thickness T of the first layer (I) is 2/5 or higher, the upper limit of the content of oxygen atoms in the layer region (O) may preferably be 30 atomic % or less, more preferably 20 atomic % or less, most preferably 10 atomic % or less.

In the present invention, the layer region (O) containing oxygen atoms for constituting the first layer (I) may preferably be provided so as to have a localized region (B) containing oxygen atoms at a relatively higher content on the substrate side and in the vicinity of the free surface as described above, and in this case adhesion between the substrate and the light receiving layer can be further improved, and improvement of accepting potential can also be effected.

The localized region (B), as explained in terms of the symbols shown in FIGS. 11 to 16, may be desirably provided within 5μ from the interface position $t_B$ or $t_T$.

In the present invention, the above localized region (B) may be made to be identical with the whole layer region ($L_T$) up to the depth of 5μ thickness from the interface position $t_B$ or $t_T$, or alternatively a part of the layer region ($L_T$).

It may suitably be determined depending on the characteristics required for the first layer (I) layer to be formed, whether the localized region is made a part or whole of the layer region ($L_T$).

The localized region (B) may preferably be formed according to such a layer formation that the maximum Cmax of the content of oxygen atoms in a distribution in the layer thickness direction may preferably be 500 atomic ppm or more, more preferably 800 atomic ppm or more, most preferably 1000 atomic ppm or more.

That is, according to the present invention, the layer region (O) containing oxygen atoms is formed so that the maximum value Cmax of the depth profile may exist within a layer thickness of 5μ from the substrate side or the free surface side (the layer region within 5μ thickness from $t_B$ or $t_T$).

In the present invention, formation of the first layer region (G) constituted of a-Ge(Si,H,X) may be conducted according to the vacuum deposition method utilizing discharging phenomenon, such as glow discharge method, sputtering method or ion-plating method. For example, for formation of the first layer region (G) constituted of a-Ge(Si,H,X) according to the glow discharge method, the basic procedure comprises introducing a starting gas for Ge supply capable of supplying germanium atoms (Ge) optionally together with a starting gas for Si supply capable of supplying silicon atoms (Si), and a starting gas for introduction of hydrogen atoms (H) and/or a starting gas for introduction of halogen atoms (X) into a deposition chamber which can be internally brought to a reduced pressure, and forming a plasma atmosphere of these gases by exciting glow discharge in said deposition chamber, thereby forming a layer consisting of a-Ge(Si,H,X) on the surface of a substrate set at a predetermined position. For incorporation of germanium atoms in an ununiform depth profile, the content of germanium atoms may be controlled following a desired change rate curve in formation of the layer comprising a-Ge(Si,H,X). Alternatively, for formation according to the sputtering method, by use of a target constituted of Si or two sheets of targets of said target and a target constituted of Ge, or a target of a mixture of Si and Ge in an atmosphere of an inert gas such as Ar, He, etc. or a gas mixture based on these gases, a starting gas for Ge supply optionally diluted with a diluting gas such as He, Ar, etc. and together with, if desired, a gas for introduction of hydrogen atoms (H) and/or halogen atoms (X) may be introduced into a deposition chamber for sputtering and a plasma atmosphere of desired gases are formed. For making the distribution of germanium atoms ununiform, for example, the flow rate of the starting gas for Ge supply may be controlled according to the change rate curve as desired in carrying out sputtering of the target.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

As the substances which can be starting gases for Ge supply, there may be effectively employed or gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, GeH4, Ge2H6 and $Ge_3H_8$ are preferred with respect to easy handling during layer formation and efficiency for supplying Ge.

Effective starting gases for introduction of halogen atoms to be used in the present invention may include a large number of halogenic compounds, as exemplified preferably by gaseous or gasifiable halogenic compounds such as halogenic gases, halides, interhalogen compounds, silane derivatives substituted with halogens and others.

Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the characteristic photoconductive member of the present invention is formed according to the glow discharge method by employment of such a silicon compound containing halogen atoms, it is possible to form the first layer region (G) comprising a-SiGe containing halogen atoms on a desired substrate without use of a hydrogenated silicon gas as the starting gas capable of supplying Si together with the starting gas for Ge supply.

In the case of forming the first layer region (G) containing halogen atoms according to the glow discharge method, the basic procedure comprises introducing, for example, a silicon halide as the starting gas for Si supply, a hydrogenated germanium as the starting gas for Ge supply and a gas such as Ar, $H_2$, He, etc. at a predetermined mixing ratio into the deposition chamber for formation of the first layer region (G) and exciting glow discharge to form a plasma atomsphere of these gases, whereby the first layer region (G) can be formed on a desired substrate. In order to control the ratio of hydrogen atoms incorporated more easily, hydrogen gas or a gas of a silicon compound containing hydrogen atoms may also be mixed with these gases in a desired amount to form the layer.

Also, each gas is not restricted to a single species, but multiple species may be available at any desired ratio.

For formation of the first layer region (G) comprising a-Ge(Si,H,X) according to the ion-plating method, a vaporizing source such as a polycrystalline silicon or a single crystalline silicon and a polycrystalline germanium or a single crystalline germanium may be placed in an evaporating boat, and the vaporizing source is heated by the resistance heating method or the electron beam method (EB method) to be vaporized, and the flying vaporized product is permitted to pass through a desired gas plasma atmosphere.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

In the present invention, as the starting gas for introduction of halogen atoms, the halides or halo-containing silicon compounds as mentioned above can effectively be used. Otherwise, it is also possible to use effectively as the starting material for formation of the layer region (G) gaseous or gasifiable substances, including halides containing hydrogen atom as one of the constituents, e.g. hydrogen halide such as HF, HCl, HBr, HI, etc.; halo-substituted hydrogenated silicon such as $SiH_2F_2$, $SiH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, GeIhd 4, $GeF_2$, $GeCl_2$, $GeBr_2$, $GeI_2$, etc.

Among these substances, halides containing hydrogen atoms can preferably be used as the starting material for introduction of halogen atoms, because hydrogen atoms, which are very effective for controlling electrical or photoelectric characteristics, can be introduced into the layer simultaneously with introduction of halogen atoms during formation of the first layer region (G).

For introducing hydrogen atoms structurally into the first layer region (G), other than those as mentioned above, $H_2$ of a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon or a silicon compound for supplying Si can be permitted to co-exist in a deposition chamber, followed by excitation of discharging.

According to a preferred embodiment of the present invention, the amount of hydrogen atoms (H) or the amount of halogen atoms (X) or the sum of the amounts of hydrogen atoms and halogen atoms (H+X) to be contained in the first layer region (G) constituting the light receiving layer to be formed should preferably be 0.01 to 40 atomic %, more preferably 0.05 to 30 atomic %, most preferably 0.1 to 25 atomic %.

For controlling the amount of hydrogen atoms (H) and/or halogen atoms (X) to be contained in the first layer region (G), for example, the substrate temperature and/or the amount of the starting materials used for incorporation of hydrogen atoms (H) or halogen atoms (X) to be introduced into the deposition device system, discharging power, etc. may be controlled.

In the present invention, for formation of the second layer region (S) constituted of a-Si(H,X), the starting materials (I) for formation of the first layer region (G), from which the starting material for the starting gas for supplying Ge is omitted, are used as the starting materials (II) for formation of the second layer region (S), and layer formation can be effected following the same procedure and conditions as in formation of the first layer region (G).

More specifically, in the present invention, formation of the second layer region (S) constituted of a-Si(H,X) may be carried out according to the vacuum deposition method utilizing discharging phenomenon such as the glow discharge method, the sputtering method or the ion-plating method. For example, for formation of the second layer region (S) constituted of a-Si(H,X), the basic procedure comprises introducing a starting gas for Si supply capable of supplying silicon atoms as described above, optionally together with starting gases for introduction of hydrogen atoms (H) and/or halogen atoms (X), into a deposition chamber which can be brought internally to a reduced pressure and exciting glow discharge in said deposition chamber, thereby forming a layer comprising a-Si(H,X) on a desired substrate placed at a predetermined position. Alternatively, for formation according to the sputtering method, gases for introduction of hydrogen atoms (H) and/or halogen atoms (X) may be introduced into a deposition chamber for sputtering when effecting sputtering of a target constituted of Si in an inert gas such as Ar, He, etc. or a gas mixture based on these gases.

In the present invention, the amount of hydrogen atoms (H) or the amount of halogen atoms (X) or the sum of the amounts of hydrogen atoms and halogen atoms (H+X) to be contained in the second layer region (S) constituting the first layer (I) to be formed should preferably be 1 to 40 atomic %, more preferably 5 to 30 atomic %, most preferably 5 to 25 atomic %.

In the present invention, for provision of the layer region (O) containing oxygen atoms in the first layer (I), a starting material for introduction of oxygen atoms may be used together with the starting material for formation of the first layer (I) as mentioned above during formation of the layer and may be incorporated in the layer while controlling their amounts.

When the glow discharge method is to be employed for formation of the layer region (O), the starting material as the starting gas for formation of the layer region (O) may be constituted by adding a starting material for introduction of oxygen atoms to the starting material selected as desired from those for formation of the first layer (I) as mentioned above. As such a starting material for introduction of oxygen atoms, there may be employed most of gaseous or gasifiable substances containing at least oxygen atoms as constituent atoms.

For example, there may be employed a mixture of a starting gas containing silicon atoms (Si) as constituent atoms, a starting gas containing oxygen atoms (O) as constituent atoms and optionally a starting gas containing hydrogen atoms (H) and/or halogen atoms (X) as constituent atoms at a desired mixing ratio; a mixture of a starting gas containing silicon atoms (Si) as constituent atoms and a starting gas containing oxygen atoms and hydrogen atoms as constituent atoms also at a desired mixing ratio; or a mixture of a starting gas containing silicon atoms (Si) as constituent atoms and a starting gas containing the three atoms of silicon atoms (Si), oxygen atoms (O) and hydrogen atoms (H) as constituent atoms.

Alternatively, there may also be employed a mixture of a starting gas containing silicon atoms (Si) and hydrogen atoms (H) as constituent atoms and a starting gas containing oxygen atoms (O) as constituent atoms.

More specifically, there may be mentioned, for example, oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxygen atoms (O) and hydrogen atoms (H) as constituent atoms such as disiloxane ($H_3SiOSiH_3$), trisiloxane ($H_3SiOSiH_2OSiH_3$), and the like.

For formation of the layer region (0) containing oxygen atoms according to the sputtering method, a single crystalline or polycrystalline Si wafer or $SiO_2$ wafer or a wafer containing Si and $SiO_2$ mixed therein may be employed as the target and sputtering of these wafers may be conducted in various gas atmospheres.

For example, when Si wafer is employed as the target, a starting gas for introduction of oxygen atoms optionally together with a starting gas for introduction of hydrogen atoms and/or halogen atoms, which may optionally be diluted with a diluting gas, may be introduced into a deposition chamber for sputtering to form gas plasma of these gases, in which sputtering of the aforesaid Si wafer may be effected.

Alternatively, by the use of separate targets of Si and $SiO_2$ or one sheet of a target containing Si and $SiO_2$ mixed therein, sputtering may be effected in an atmosphere of a diluting gas as a gas for sputtering or in a gas atmosphere containing at least hydrogen atoms (H) and/or halogen atoms (X) as constituent atoms. As the starting gas for introduction of oxygen atoms, there may be employed the starting gases shown as examples in the glow discharge method previously described also as effective gases in case of sputtering.

In the present invention, when providing a layer region (O) containing oxygen atoms during formation of the first layer (I), formation of the layer region (O) having a desired depth profile in the direction of layer thickness formed by varying the content C(O) of oxygen atoms contained in said layer region (O) may be conducted in case of glow discharge by introducing a starting gas for introduction of oxygen atoms of which the content C(O) is to be varied into a deposition chamber, while varying suitably its gas flow rate according to a desired change rate curve. For example, by the manual method or any other method conventionally used such as an externally driven motor, etc., the opening of certain needle valve provided in the course of the gas flow channel system may be gradually varied. During this procedure, the rate of variation is not necessarily required to be linear, but the flow rate may be controlled according to a variation rate curve previously designed by means of, for example, a microcomputer to give a desired content curve.

In case when the layer region (O) is formed by the sputtering method, formation of a desired depth profile of oxygen atoms in the direction of layer thickness by varying the content C(O) of oxygen atoms in the direction of layer thickness may be performed first similarly as in case of the glow discharge method by employing a starting material for introduction of oxygen atoms under gaseous state and varying suitably as desired the gas flow rate of said gas when introduced into the deposition chamber.

Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

In the photoconductive member of the present invention, a substance (C) for controlling conductivity can also be incorporated in the first layer region (G) containing germanium atoms and/or the second layer region (S) containing no germanium atoms, whereby the conductivity characteristics of said layer region (G) and/or said layer region (S) can be freely controlled as desired.

In the present invention, the layer region (PN) containing a substance (C) for controlling conductivity characteristics may provided at a part or the whole layer region of the first layer (I). Alternatively, the layer region (PN) may be provided at a part or the whole layer region of the layer region (G) or the layer region (S).

As a substance (C) for controlling conductivity characteristics, there may be mentioned so called impurities in the field of semiconductors. In the present invention, there may be included p-type impurities giving p-type conductivity characteristics and n-type impurities giving n-type conductivity characteristics to Si or Ge.

More specifically, there may be mentioned as p-type impurities atoms belonging to the group III of the periodic table (Group III atoms), such as B (boron), Al (aluminum), Ga (gallium), In (indium), Tl (thallium), etc., particularly preferably B and Ga.

An n-type impurities, there may be included the atoms belonging to the group V of the periodic table, (Group V atoms), such as P (phosphorus), As (arsenic), Sb (antimony), Bi (mismuth), etc., particularly preferably P and As.

In the present invention, the content of the substance (C) for controlling the conductivity in the first layer (I) may be suitably be selected depending on the conductivity characteristics required for said first layer (I) or the characteristics of other layers or the substrate provided in direct contact with said first layer (I), depending on the organic relation such as the relation, with the characteristics at the contacted interface with said other layers or the substrate.

When the above substance for controlling conductivity characteristics is to be incorporated in the first layer (I) locally at the desired layer region of said first layer (I), particularly at an end portion layer region (E) on the substrate side of the first layer (I), the content of the substance for controlling conductivity characteristics is determined suitably with due consideration of the relationships with characteristics of other layer regions provided in direct contact with said layer region (E) or the characteristics at the contacted interface with said other layer regions.

In the present invention, the content of the substance (C) for controlling conductivity characteristics contained in the layer region (PN) should be preferably be 0.01 to $5\times10^4$ atomic ppm, more preferably 0.5 to $1\times10^4$ atomic ppm, most preferably 1 to $5\times10^3$ atomic ppm.

In the present invention, when the content of said substance (C) for controlling conductivity characteristics in the layer region (PN) is preferably 30 atomic ppm or more, more preferably 50 atomic ppm or more, most preferably 100 atomic ppm or more, the substance (C) is desired to be contained locally at a part of the layer region of the first layer (I), particularly localized at the end portion layer region (E) on the substrate side of the first layer (I).

In the above constitution, by incorporating the substance (C) for controlling conductivity characteristics in the end portion layer region (E) on the substrate side of the first layer (I) so that the content may be the above value or higher, for example, in the case when said substance (C) to be incorporated is a p-type impurity as mentioned above, migration of electrons injected from the substrate side into the first layer (I) can be effectively inhibited when the free surface of the first layer (I) is subjected to the charging treatment to ⊕ polarity. On the other hand, in the case when the substance to be incorporated is a n-type impurity as mentioned above, migration of positive holes injected from the substrate side into the first layer (I) can be effectively inhibited when the free surface of the first layer (I) is subjected to the charging treatment to ⊖ polarity.

Thus, in the case when a substance for controlling conductive characteristics of one polarity is incorporated in the aforesaid end portion layer region (E), the remaining layer region of the first layer (I), namely the layer region (Z) excluding the aforesaid end portion layer region (E) may contain a substance for controlling conductive characteristics of the other polarity, or a substance for controlling conductivity characteristics of the same polarity may be contained therein in an amount by far smaller than that practically contained in the end portion layer region (E).

In such a case, the content of the substance (C) for controlling conductivity characteristics contained in the above layer region (Z) can be determined adequately as desired depending on the polarity or the content of the substance contained in the end portion layer region (E), but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the end portion layer region (E) and the layer region (Z), the content in the layer region (Z) should preferably be 30 atomic ppm or less. As different from the cases as mentioned above, in the present invention, it is also possible to provide in the first layer (I) a layer region containing a substance for controlling conductivity having one polarity and a layer region containing a substance for controlling conductivity having the other polarity in direct contact with each other, thus providing a so called depletion layer at said contact region. In short, for example, a layer containing the aforesaid p-type impurity and a layer region containing the aforesaid n-type impurity are provided in the light receiving layer in direct contact with each other to form the so called p-n junction, whereby a depletion layer can be provided.

For incorporating a substance (C) for controlling conductivity characteristics such as the group III atoms or the group V atoms structurally into the first layer (I), a starting material for introduction of the group III atoms or a starting material for introduction of the group V atoms may be introduced under gaseous state into a deposition chamber together with the starting materials for formation of the second layer region during layer formation. As the starting material which can be used for introduction of the group III atoms, it is desirable to use those which are gaseous at room temperature under atmospheric pressure or can readily be gasified at least under layer forming conditions. Typical examples of such starting materials for introduction of the group III atoms, there may be included as the compounds for introduction of boron atoms boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydrides such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$ and the like. Otherwise, it is also possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like effectively as the starting material for introduction of the group V atoms.

In the photoconductive member 100 shown in FIG. 1, the second layer (II) 103 formed on the first layer (I) has a free surface and is provided for accomplishing the objects of the present invention primarily in humidity resistance, continuous repeated use characteristic, dielectric strength, use environment characteristic and durability.

The second layer (II) is constituted of an amorphous material containing silicon atoms (Si) and at least one of carbon atoms (C) and nitrogen atoms (N) optionally together with at least one of hydrogen atoms (H) and halogen atoms (X).

The above amorphous material constituting the second layer (II) may include an amorphous material containing silicon atoms (Si) and carbon atoms (C), optionally together with hydrogen atoms (H) and/or halogen atoms (X) (hereinafter written as "a-$(Si_xC_{1-x})_y(H,X)_{1-y}$", wherein $0<x$, $y<1$), and an amorphous material containing silicon atoms (Si) and nitrogen atoms (N), optionally together with hydrogen atoms (H) and/or halogen atoms (X) (hereinafter written as "a-$(Si_xN_{1-x})_y(H,X)_{1-y}$", wherein $0<x$, $y<1$).

Formation of the second amorphous layer (II) may be performed according to the glow discharge method, the sputtering method, the ion implantation method, the ion plating method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of carbon atoms, nitrogen atoms, hydrogen atoms, halogen atoms with silicon atoms (Si) into the second amorphous layer (II) to be prepared, there may preferably be employed the glow discharge method or the sputtering method.

Further, in the present invention, the glow discharge method and the sputtering method may be used in combination in the same device system to form the second layer (II).

In the present invention, suitable halogen atoms (X) contained in the second layer (II) are F, Cl, Br and I, particularly preferably F and Cl.

For formation of the second amorphous layer (II) according to the glow discharge method, starting gases for formation of the second layer (II), which may optionally be mixed with a diluting gas at a predetermined mixing ratio, may be introduced into a deposition chamber for vacuum deposition in which a substrate is placed, and glow discharge is excited in said deposition chamber to form the gases introduced into a gas plasma, thereby depositing an amorphous material constituting the second layer (II) on the first amorphous layer (I) already formed on the substrate.

In the present invention, the starting gases which can be effectively used for formation of the second layer (II) may include gaseous or readily gasifiable substances at normal temperature and normal pressure.

In the present invention, as starting gases for formation of a-$(Si_xC_{1-x})_y(H,X)_{1-y}$, there may be employed most of substances containing at least one of silicon atoms (Si), carbon atoms (C), hydrogen atoms (H) and halogen atoms (X) as constituent atoms which are gaseous or gasified substances of readily gasifiable ones.

When employing a starting gas containing Si as the constituent atom as one of Si, C, H and X a mixture of a starting gas containing Si as constituent atom, a starting gas containing C as constituent atom and optionally a starting gas containing H as constituent atom and/or a starting gas containing X as constituent atom at a desired mixing ratio, or a mixture of a starting gas containing Si as constituent atom and a starting gas containing C and H and/or a starting gas containing X as constituent atoms as constituent atoms also at a desired ratio, or a mixture of a starting gas containing Si as constituent atom and a starting gas containing three constituent atoms of Si, C and H or a starting gas containing three constituent atoms of Si, C and X.

Alternatively, it is also possible to use a mixture of a starting gas containing Si and H as constituent atoms with a starting gas containing C as constituent atom or a mixture of a starting gas containing Si and X as constituent atoms and a starting gas containing C as constituent atom.

In the present invention, as starting gases for formation of a-$(Si_xN_{1-x})_y(H,X)_{1-y}$, there may be employed most of substances containing at least one of silicon atoms (Si), nitrogen atoms (C), hydrogen atoms (H) and halogen atoms (X) as constituent atoms which are gaseous or gasified substances of readily gasifiable ones.

For example, when employing a starting gas as the constituent atoms as one of Si, N, H and X, a mixture of a starting gas containing Si as constituent atom, a starting gas containing N as constituent atom and optionally a starting gas containing H as constituent atom and/or a starting gas containing X as constituent atom at a desired mixing ratio, or a mixture of a starting gas containing Si as constituent atom and a starting gas containing N and H and/or a starting gas containing X as constituent atoms as constituent atoms also at a desired ratio, or a mixture of a starting gas containing Si as constituent atom and a starting gas containing three constituent atoms of Si, N and H or a starting gas containing three constituent atoms of Si, N and X.

Alternatively, it is also possible to use a mixture of a starting gas containing Si and H as constituent atoms with a starting gas containing N as constituent atom or a mixture of a starting gas containing Si and X as constituent atoms and a starting gas containing N as constituent atom.

Formation of the second layer (II) according to the sputtering method may be practiced as follows.

In the first place, when a target constituted of Si is subjected to sputtering in an atmosphere of an inert gas such as Ar, He, etc. or a gas mixture based on these gases, a starting gas for introduction of carbon atoms (C) and/or a starting gas for introduction of nitrogen atoms (N) may be introduced, optionally together with starting gases for introduction of hydrogen atoms (H) and/or halogen atoms (X), into a vacuum deposition chamber for carrying out sputtering.

In the second place, carbon atoms (C) and/or nitrogen atoms (N) can be introduced into the second layer (II) formed by use of a target constituted of a mixture of Si and C and/or $Si_3N_4$, or two sheets of targets of a target constituted of Si and a target constituted of a mixture of Si and C and/or $Si_3N_4$, or a target constituted of Si and a mixture of Si and C and/or $Si_3N_4$. In this case, if the starting gas for introduction of carbon atoms (C) and/or the starting gas for introduction of nitrogen atoms (N) as mentioned above, the amount of carbon atoms (C) and/or nitrogen atoms (N) to be incorporated in the second layer (II) can easily be controlled as desired by controlling the flow rate thereof.

The amount of carbon atoms (C) and/or nitrogen atoms (N) to be incorporated into the second layer (II) can be controlled as desired by controlling the flow rate of the starting gas for introduction of carbon atoms (C) and/or the starting gas for introduction of nitrogen atoms (N), adjusting the ratio of carbon atoms (C) and/or nitrogen atoms (N) in the target for introduction of carbon atoms and/or nitrogen atoms during preparation of the target, or performing both of these.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

By use of these starting materials, H can also be incorporated in the second layer (II) formed by adequate choice of the layer forming conditions.

As the starting materials effectively used for supplying Si, in addition to hydrogenated silicon as mentioned above, there may be included silicon compounds containing halogen atoms (X), namely the so called silane derivatives substituted with halogen atoms, including halogenated silicon such as $SiF_4$, $Si_2F_6$, $SiCl_4$, $SiBr_4$, $SiCl_3Br$, $SiCl_2Br_2$, $SiClBr_3$, $SiCl_3I$, etc., as preferable ones.

Further, halides containing hydrogen atom as one of the constituents, which are gaseous or gasifiable, such as halo-substituted hydrogenated silicon, including $SiH_2F_2$,$SiH_2I_2$, $SiH_2Cl_2$, $SiHCl_3$, $SiH_3Cl$, $SiH_3Br$, $SiH_2Br_2$, $SiHBr_3$, etc. may also be mentioned as the effective starting materials for supplying Si for formation of the second layer (II).

Also, in the case of employing a silicon compound containing halogen atoms (X), X can be introduced together with Si in the layer formed by suitable choice of the layer forming conditions as mentioned above.

Effective starting materials to be used as the starting gases for introduction of halogen atoms (X) in formation of the second layer (II) in the present invention, there may be included, in addition to those as mentioned above, for example, halogen gases such as fluorine, chlorine, bromine and iodine; interhalogen compounds such as BrF, ClF, $ClF_3$, $ClF_5$, $BrF_5$, $BrF_3$, $IF_3$, $IF_5$, $IF_7$, ICl, IBr, etc.

The starting gas for introduction of carbon atoms to be used in formation of the second layer (II) may include compounds containing C and H as constituent atoms such as saturated hydrocarbons containing 1 to 4 carbon atoms, ethylenic hydrocarbons having 2 to 4 carbon atoms, acetylenic hydrocarbons having 2 to 3 carbons atoms.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$).

Otherwise, it is also possible to use halo-substitued paraffinic hydrocarbons such as $CF_4$, $CCl_4$, $CBr_4$, $CHF_3$, $CH_2F_2$, $CH_3F$, $CH_3Cl$, $CH_3Br$, $CH_3I$, $C_2H_5Cl$, etc.; silane derivatives, including alkyl silanes such as $Si(CH_3)_4$, $Si(C_2H_5)_4$, etc. and halogen-containing alkyl silanes such as $SiCl(CH_3)_3$, $SiCl_2(CH_3)_2$, $SiCl_3CH_3$, etc. as effective ones.

The starting material effectively used as the starting gas for introduction of nitrogen atoms (N) to be used during formation of the second layer (II), it is possible to use compounds containing N as constituent atom or compounds containing N and H as constituent atoms, such as gaseous or gasifiable nitrogen compounds, nitrides and azides, including for example, nitrogen ($N_2$), ammonia ($NH_3$), hydrazine ($H_2NNH_2$), hydrogen azide ($HN_3$), ammonium azide ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), nitrogen tetrafluoride ($F_4N_2$) and the like.

The starting materials for formation of the above second amorphous layer (II) may be selected and employed as desired in formation of the second amorphous layer (II) so that silicon atoms, carbon atoms and/or nitrogen atoms, optionally together with hydrogen atoms or halogen atoms may be contained at a predetermined composition ratio in the second amorphous layer (II) to be formed.

For example, $Si(CH_3)_4$ as the material capable of incorporating easily silicon atoms, carbon atoms and hydrogen atoms and forming a second amorphous layer (II) having desired characteristics and $SiHCl_3$, $SiCl_4$, $SiH_2Cl_2$ or $SiH_3Cl$ as the material for incorporating halogen atoms may be mixed at a predetermined mixing ratio and introduced under gaseous state into a device for formation of a second amorphous layer (II), followed by excitation of glow discharge, whereby there can be formed a second amorphous layer (II) comprising a-$(Si_xC_{1-x})_y(Cl+H)_{1-y}$.

In the present invention, as the diluting gas to be used in formation of the second layer (II) by the glow discharge method or the sputtering method, there may be included the so called rare gases such as He, Ne and Ar as preferable ones.

The second amorphous layer (II) in the present invention should be carefully formed so that the required characteristics may be given exactly as desired.

That is, the above material constituted of Si, C and/or N, optionally together with H and/or X can take various forms from crystalline to amorphous, electrical properties from conductive through semi-conductive to insulating and photoconductive properties from photoconductive to non-photoconductive depending on the preparation conditions. Therefore, in the present invention, the prepration conditions are strictly selected as desired so that there may be formed the amorphous material for constitution of the second layer (II) having desired characteristics depending on the purpose. For example, when the second amorphous layer (II) is to be provided primarily for the purpose of improvement of dielectric strength, the amorphous material for constitution of the second layer is prepared as an amorphous material having marked electric insulating behaviours under the use environment.

Alternatively, when the primary purpose for provision of the second amorphous layer (II) is improvement of continuous repeated use characteristics or environmental use characteristics, the degree of the above electric insulating property may be alleviated to some extent and the aforesaid amorphous material may be prepared as an amorphous material having sensitivity to some extent to the light irradiated.

In forming the second amorphous layer (II) on the surface of the first amorphous layer (I), the substrate temperature during layer formation is an important factor having influences on the structure and the characteristics of the layer to be formed, and it is desired in the present invention to control severely the substrate temperature during layer formation so that the second amorphous layer(II) having intended characteristics may be prepared as desired.

As the substrate temperature in forming the second amorphous layer (II) for accomplishing effectively the objects in the present invention, there may be selected suitably the optimum temperature range in conformity with the method for forming the second amorphous layer (II) in carrying out formation of the second amorphous layer (II), preferably 20° to 400 ° C., more preferably 50° to 350° C., most preferably 100° to 300° C. For formation of the second layer (II), the glow discharge method or the sputtering method may be advantageously adopted, because severe control of the composition ratio of atoms constituting the layer or control of layer thickness can be conducted with relative ease as compared with other methods. In case when the amorphous material constituting the second layer (II) is to be formed according to these layer forming methods, the discharging power during layer formation is one of important factors influencing the characteristics of the above amorphous material for constitution of the second layer (II) to be prepared, similarly as the aforesaid substrate temperature.

The discharging power condition for preparing effectively the amorphous material for constitution of the second layer (II) having characteristics for accomplishing the objects of the present invention with good productivity may preferably be 10 to 300 W, more preferably 20 to 250 W, most preferably 50 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the substrate temperature, discharging power for preparation of the second amorphous layer (II). However, these factors for layer formation should not be determined separately independently of each other, but it is desirable that the optimum values of respective layer forming factors should be determined based on mutual organic relationships so that the second layer (II) having desired characteristics may be formed.

The respective contents of carbon atoms, nitrogen atoms, or both thereof in the second layer (II) in the photoconductive member of the present invention are important factors for obtaining the desired characteristics to accomplish the objects of the present invention, similarly as the conditions for preparation of the second amorphous layer (II). The respective contents of carbon atoms, nitrogen atoms or the sum of both contained in the second layer (II) in the present invention are determined as desired depending on the amorphous material constituting the second layer (II) and its characteristics.

More specifically, the amorphous material represented by the above formula a-$(Si_xC_{1-x})_y(H,X)_{1-y}$ may be roughly classified into an amorphous material constituted of silicon atoms and carbon atoms (hereinafter written as "a-$Si_aC_{1-a}$", where $0<a<1$), an amorphous material constituted of silicon atoms, carbon atoms and hydrogen atoms (hereinafter written as a-$(Si_bC_{1-b})_cH_{1-c}$, where $0<b$, $c<1$) and an amorphous material constituted of silicon atoms, carbon atoms, halogen atoms and optionally hydrogen atoms (hereinafter written as "a-$(Si_dC_{1-d})_e(H,X)_{1-e}$", where $0<d$, $e<1$).

In the present invention, when the second layer (II) is to be constituted of a-$Si_aC_{1-a}$, the content of carbon atoms (C) in the second layer (II) may generally be $1\times10^{-3}$ to 90 atomic %, more preferably 1 to 80 atomic %, most preferably 10 to 75 atomic %, namely in terms of representation by a, a being preferably 0.1 to 0.99999, more preferably 0.2 to 0.99, most preferably 0.25 to 0.9.

In the present invention, when the second layer (II) is to be constituted of a-$(Si_bC_{1-b})_cH_{1-c}$, the content of carbon atoms (C) may preferably be $1\times10^{-3}$ to 90 atomic %, more preferably 1 to 90 atomic %, most preferably 10 to 80 atomic %, the content of hydrogen atoms preferably 1 to 40 atomic %, more preferably 2 to 35 atomic %, most preferably 5 to 30 atomic %, and the photoconductive member formed when the hydrogen content is within these ranges can be sufficiently applicable as excellent one in practical aspect.

That is, in terms of the representation by the above a-$(Si_bC_{1-b})_cH_{1-c}$, b should preferably be 0.1 to 0.99999, more preferably 0.1 to 0.99, most preferably 0.15 to 0.9, and c preferably 0.6 to 0.99, more preferably 0.65 to 0.98, most preferably 0.7 to 0.95.

When the second layer (II) is to be constituted of a-$(Si_dC_{1-d})_e(H,X)_{1-e}$, the content of carbon atoms may preferably be $1\times10^{-3}$ to 90 atomic %, more preferably 1 to 90 atomic %, most preferably 10 to 80 atomic %, the content of halogen atoms preferably 1 to 20 atomic %, more preferably 1 to 18 atomic %, most preferably 2 to 15 atomic %. When the content of halogen atoms is within these ranges, the photoconductive member prepared is sufficiently applicable in practical use. The content of hydrogen atoms optionally contained may preferably be 19 atomic % or less, more preferably 13 atomic % or less.

That is, in terms of representation by d and e in the above a-$(Si_dC_{1-d})_e(H,X)_{1-e}$, d should preferably be 0.1 to 0.99999, more preferably 0.1 to 0.99, most preferably 0.15 to 0.9, and e preferably 0.8 to 0.99, more preferably 0.82–0.99, most preferably 0.85 to 0.98.

Also, the amorphous material represented by the above formula a-$(Si_xN_{1-x})_y(H,X)_{1-y}$ may be roughly classified into an amorphous material constituted of silicon atoms and nitrogen atoms (hereinafter referred to as "a-$Si_aN_{1-a}$", where $0<a<1$), an amorphous material constituted of silicon atoms, nitrogen atoms and hydrogen atoms (hereinafter written as a-$(Si_bN_{1-b})_cH_{1-c}$, where $0<b$, $c<1$) and an amorphous material constituted of silicon atoms, nitrogen atoms, halogen atoms and optionally hydrogen atoms (hereinafter written as "a-$(Si_dN_{1-d})_e(H,X)_{1-e}$", where $0<d$, $e<1$).

In the present invention, when the second layer (II) is to be constituted of a-$Si_aN_{1-a}$, the content of nitrogen atoms in the second layer (II) may generally be $1\times10^{-3}$ to 60 atomic %, more preferably 1 to 50 atomic %, most preferably 10 to 45 atomic %, namely in terms of representation by a in the above a-$Si_aN_{1-a}$, a being preferably 0.4 to 0.99999, more preferably 0.5 to 0.99, most preferably 0.55 to 0.9.

In the present invention, when the second layer (II) is to be constitued of a-$(Si_bN_{1-b})_cH_{1-c}$, the content of nitrogen atoms may preferably be $1\times10^{-3}$ to 55 atomic %, more preferably 1 to 55 atomic %, most preferably 10 to 55 atomic %, the content of hydrogen atoms preferably 1 to 40 atomic %, more preferably 2 to 35 atomic %, most preferably 5 to 30 atomic %, and the photoconductive member formed when the hydrogen content is within these ranges can be sufficiently applicable as excellent one in practical aspect.

That is, in terms of the representation by the above a-$(Si_bN_{1-b})_cH_{1-c}$, b should preferably be 0.45 to 0.99999, more preferably 0.45 to 0.99, most preferably 0.45 to 0.9, and c preferably 0.6 to 0.99, more preferably 0.65 to 0.98, most preferably 0.7 to 0.95.

When the second layer (II) is to be constituted of a-$(Si_dN_{1-d})_e(H,X)_{1-e}$, the content of nitrogen atoms may preferably be $1\times10^{-3}$ to 60 atomic %, more preferably 1 to 60 atomic %, most preferably 10 to 55 atomic %, the content of halogen atoms preferably 1 to 20 atomic %, more preferably 1 to 18 atomic %, most preferably 2 to 15 atomic %. When the content of halogen atoms is within these ranges, the photoconductive member prepared is sufficiently applicable in practical aspect. The content of hydrogen atoms optionally contained may preferably be 19 atomic % or less, more preferably 13 atomic % or less.

That is, in terms of representation by d and e in the above a-$(Si_dN_{1-d})_e(H,X)_{1-e}$, d should preferably be 0.4 to 0.99999, more preferably 0.4 to 0.99, most preferably 0.45 to 0.9, and e preferably 0.8 to 0.99, more preferably 0.82–0.99, most preferably 0.85 to 0.98.

The range of the numerical value of layer thickness of the second amorphous layer (II) should desirably be determined depending on the intended purpose so as to effectively accomplish the objects of the present invention.

The layer thickness of the second amorphous layer (II) is also required to be determined as desired suitably with due considerations about the relationships with the contents of carbon atoms and/or nitrogen atoms, the relationship with the layer thickness of the first layer (I), as well as other organic relationships with the characteristics required for respective layer regions.

In addition, it is also desirable to have considerations from economical point of view such as productivity or capability of bulk production.

The second amorphous layer (II) in the present invention is desired to have a layer thickness preferably of 0.003 to 30μ, more preferably 0.004 to 20μ, most preferably 0.005 to 10μ.

For the purpose of enhancing the advantageous effect of nitrogen in the present invention, carbon atoms may be incorporated along with nitrogen atoms in the second layer (II). The starting gas for introduction of carbon atoms to be used in formation of the second layer (II) may include compounds containing C and H as constituent atoms such as saturated hydrocarbons containing 1 to 5 carbon atoms, ethylenic hydrocarbons having 2 to 5 carbon atoms, acetylenic hydrocarbons having 2 to 4 carbons atoms.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$). Additionally, alkylated silanes such as $Si(CH_3)_4$ and $Si(C_2H_5)_4$ may also be mentioned as starting gases having Si, C, and H as the constituent atoms.

The substrate to be used in the present invention may be either electroconductive material or insulating material. As the electroconductive material, there may be mentioned metals such as NiCr, stainless steel, Al, Cr, Mo, Au, Nb, Ta, V, Ti, Pt, Pd, etc. or alloys thereof.

As the insulating material, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating substrates should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The substrate may have a thickness, which is conveniently determined so that a photoconductive member as desired may be formed. When the photoconductive member is required to have a flexibility, the substrate is made as thin as possible, so far as the function of a substrate can sufficiently be exhibited. However, in such a case, the thickness is preferably 10 μm or more from the points of fabrication and handling of the substrate as well as its mechanical strength.

The photoconductive member of the present invention designed to have such a layer constitution as described in detail above can solve all of the various problems as mentioned above and exhibit very excellent electrical, optical, photoconductive characteristics, dielectric strength and use environment characteristics.

In particular, the photoconductive member of the present invention is free from any influence from residual potential on image formation when applied for an image forming member for electrophotography, with its electrical characteristics being stable with high sensitivity, having a high SN ratio as well as excellent light fatigue resistance and excellent repeated use characteristic and being capable of providing images of high quality of high density, clear halftone and high resolution repeatedly and stably.

Further, the photoconductive member of the present invention is high in photosensitivity over all the visible light region, particularly excellent in matching to semiconductor laser, excellent in interference inhibition and rapid in response to light.

Next, an example of the process for producing the photoconductive member of this invention is to be briefly described.

Figure 17:
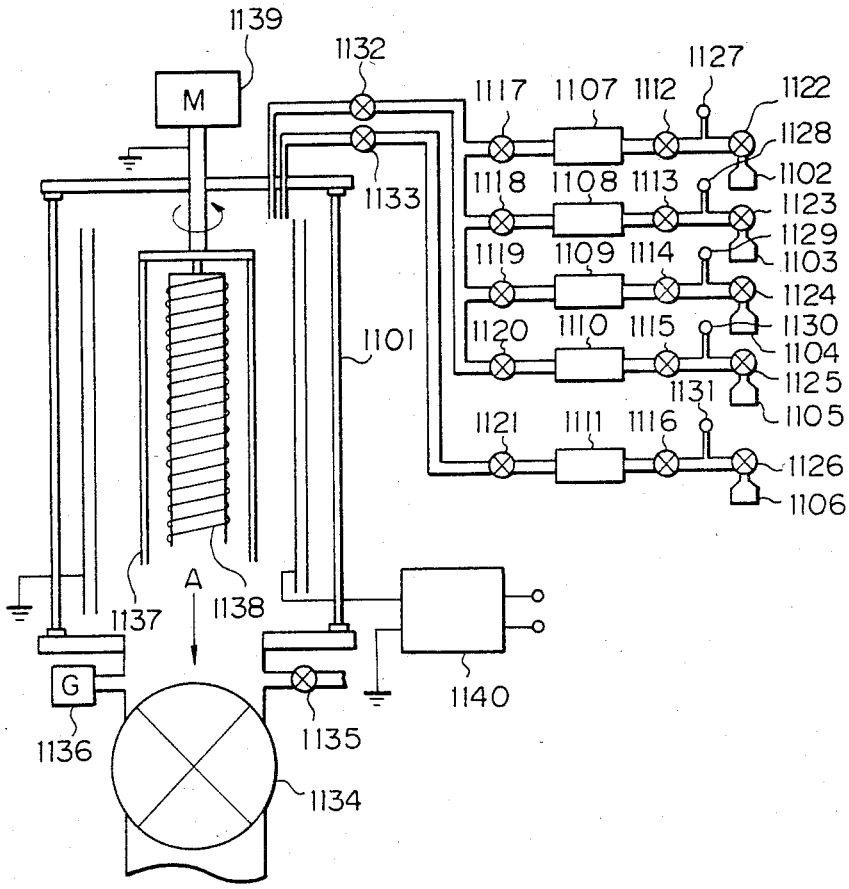
FIG. 17 is a schematic illustration of the device used in the present invention.

FIG. 17 shows one example of a device for producing a photoconductive member.

In the gas bombs 1102–1106 there are hermetically contained starting gases for formation of the photoconductive member of the present invention. For example, 1102 is a bomb containing $SiH_4$ gas diluted with He (purity: 99.999%, hereinafter abbreviated as "$SiH_4$/He"), 1103 is a bomb containing $GeH_4$ gas diluted with He (purity: 99.999%, hereinafter abbreviated as "$GeH_4$/He", 1104 is a NO gas bomb (purity: 99.999%), 1105 is a He gas bomb (purity: 99.999%) and 1106 is a $H_2$ gas bomb (purity: 99.999%).

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132, 1133 to be opened, the main valve 1134 is first opened to evacuate the reaction chamber 1101 and the gas pipelines. As the next step, when the reading on the vacuum indicator 1136 becomes $5\times10^{-6}$ Torr, the auxiliary valves 1132, 1133 and the outflow valves 1117–1121 are closed.

Referring now to an example of forming a light receiving layer region on the cylindrical substrate 1137, $SiH_4$/He gas from the gas bomb 1102, $GeH_4$/He gas from the gas bomb 1103, NO gas from the gas bomb 1104 are permitted to flow into the mass-flow controllers 1107, 1108, 1109, respectively, by opening the valves 1122, 1123 and 1124 and controlling the pressures at the outlet pressure gauges 1127, 1128, 1129 to 1 $Kg/cm^2$ and opening gradually the inflow valves 1112, 1113 and 1114, respectively. Subsequently, the outflow valves 1117, 1118, 1119 and the auxiliary valve 1132 are gradually opened to permit respective gases to flow into the reaction chamber 1101. The outflow valves 1117, 1118, 1119 are controlled so that the flow rate ratio of $SiH_4$/He gas, $GeH_4$/He gas and NO gases may have a desired value and opening of the main valve 1134 is also controlled while watching the reading on the vacuum indicator 1136 so that the pressure in the reaction chamber may reach a desired value. And, after confirming that the temperature of the substrate 1137 is set at 50°–400° C. by the heater 1138, the power source 1140 is set at a desired power to excite glow discharge in the reaction chamber 1101, and at the same time depth profiles of germanium atoms and oxygen atoms contained in the layer formed are controlled by changing gradually the flow rates of $GeH_4$/He gas and NO gas according to the change rate curve previously designed by operation of the valves 1118 and 1120 manually or according to an externally driven motor, etc.

As described above, the first layer region (G) is formed to a desired layer thickness by maintaining the glow discharge for a desired period of time. At the stage when the first layer region (G) has been formed to a desired thickness, following the same conditions and the procedure except for completely closing the outflow valve 1118 and changing the discharging conditions, if desired, glow discharging is maintained for a desired period of time, whereby the second layer region (S) containing substantially no germanium atom can be formed on the first layer region (G).

For incorporating a substance (C) for controlling the conductivity into the first layer region (G) and the second layer region (S), gases such as $B_2H_6$, $PH_3$, etc. may be added to the gases to be introduced into the deposition chamber 1101 during formation of the first layer region (G) and the second layer region (S).

Formation of a second layer (II) on the first layer (I) may be performed by use of, for example, $SiH_4$ gas and $C_2H_4$ and/or $NH_3$ gas, optionally diluted with a diluting gas such as He, according to same valve operation as in formation of the first layer (I), and exciting glow discharge following the desirable conditions.

For incorporation of halogen atoms in the second layer (II) 105, for example, $SiF_4$ gas and either one of $C_2H_4$ and/or $NH_3$ gases, or a gas mixture further added with $SiH_4$ gas, may be used to form the second layer (II) according to the same procedure as described above.

During formation of the respective layers, outflow valves other than those for necessary gases should of course be closed. Also, during formation of respective layers, in order to avoid remaining of the gas employed for formation of the preceding layer in the reaction chamber 1101 and the gas pipelines from the outflow valves 1117–1121 to the reaction chamber, the operation of evacuating the system to high vacuum by closing the outflow valves 1117–1121, opening the auxiliary valves 1132, 1133 and opening fully the main valve 1134 is conducted, if necessary.

The amount of carbon atoms and/or nitrogen atoms can be controlled as desired by, for example, in the case of glow discharge, changing the flow rate ratio of $SiH_4$ gas to $C_2H_4$ and/or $NH_3$ to be introduced into the reaction chamber 201 as desired, or in the case of layer formation by sputtering, changing the sputtering area ratio of silicon wafer to a wafer selected from among graphite wafer and/or silicon nitride wafer, or molding a target with the use of a mixture of silicon powder with the powder selected from among graphite powder, and/or silicon nitride. The content of halogen atoms (X) contained in the second layer (II) can be controlled by controlling the flow rate of the starting gas for introduction of halogen atoms such as $SiF_4$ gas when introduced into the reaction chamber.

Also, for uniformization of the layer formation, it is desirable to rotate the substrate 1137 by means of a motor 1139 at a constant speed during layer formation.

The present invention is described in more detail by referring to the following Examples.

EXAMPLE 1

By using the preparation device shown in FIG. 17, samples of image forming members for electrophotography (Sample Nos. 11-1A to 17-3A, Table 2A) were prepared on a cylindrical aluminum substrate under the condition shown in Table 1A.

Figure 18:
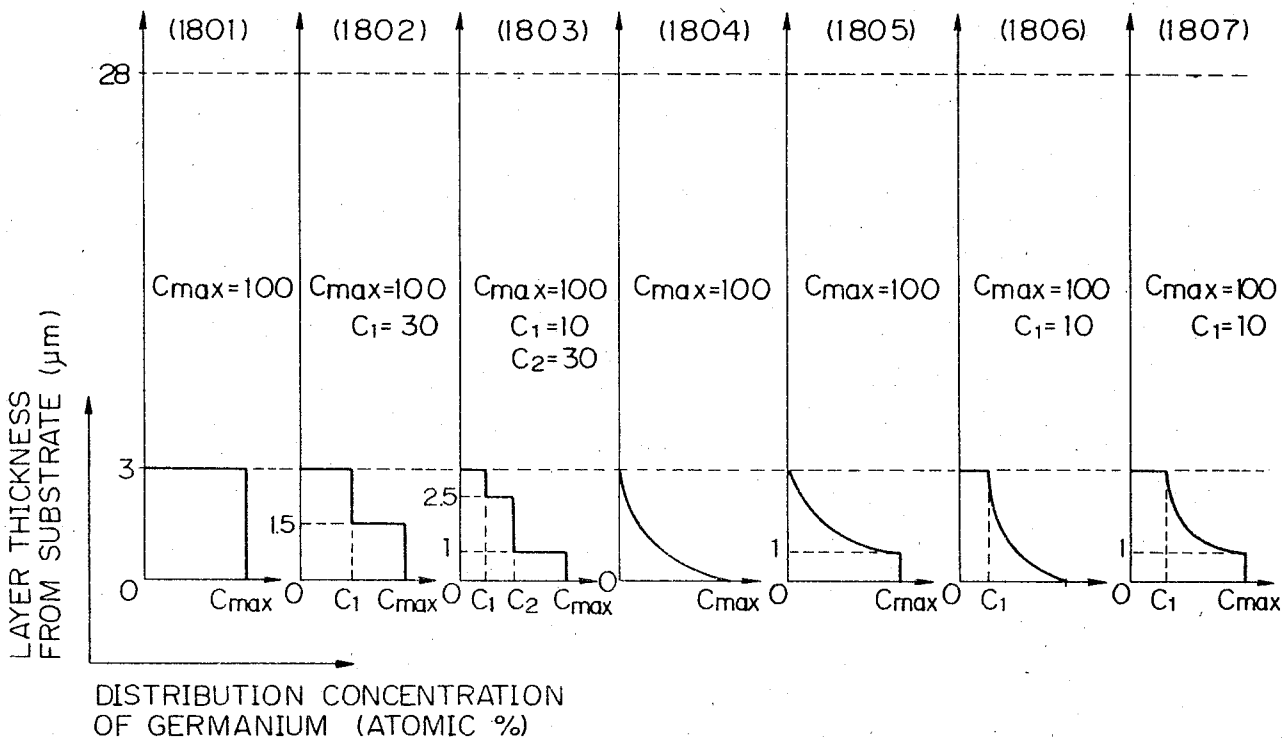
FIGS. 18 and 19 each shows a distribution of the respective atoms in Examples of the present invention.
Figure 19:
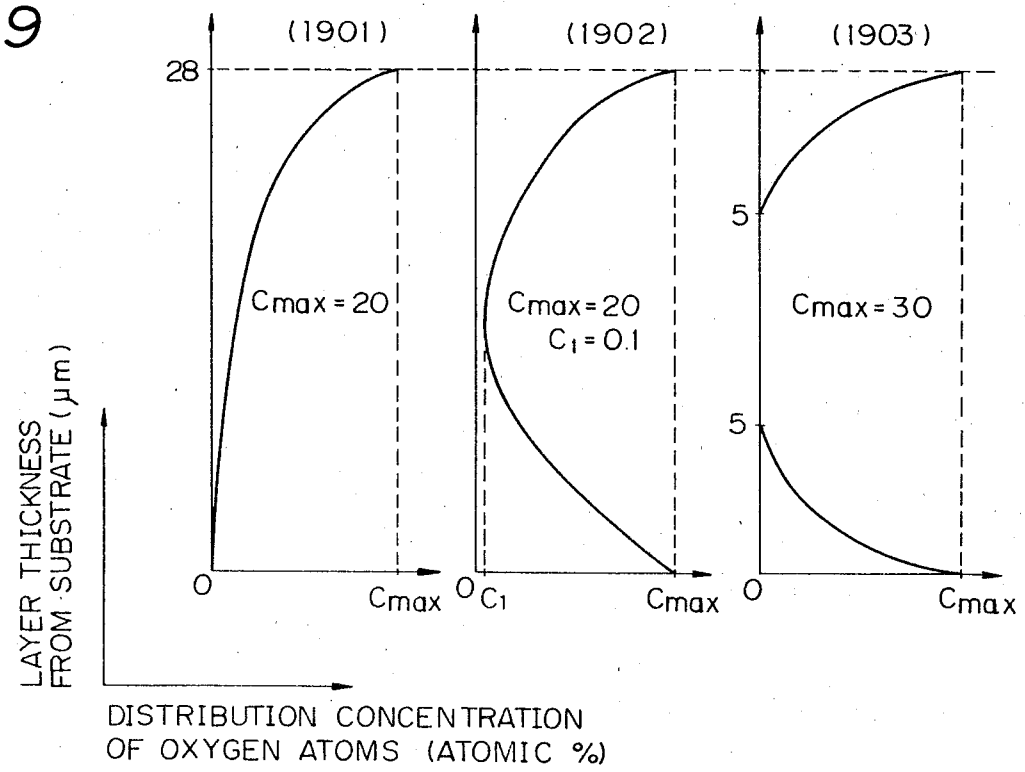

The concentration distributions of germanium atoms and oxygen atoms in the sample are shown in FIG. 18, and FIG. 19, respectively.

The sample thus prepared was set on an experimental charge-exposure device, and corona charging was effected at ⊕5.0 KV for 0.3 second, followed by immediate irradiation of a light image of a transmissive test chart with a tungsten lamp light at an irradiation dose of 2 lux-sec.

Immediately thereafter, a negatively chargeable developer (containing a toner and a carrier) was cascaded onto the surface of the image forming member, thus giving a good toner image thereon. The toner image was transferred onto a transfer paper by corona charging of ⊕5.0 KV, giving a clear image of high density with excellent resolution and sufficient gradation reproducibility.

The evaluation of quality of the transferred toner image was repeated in the same manner as described above except that semi-conductor laser of GaAs type of 810 nm (10 mW) was used in place of the tungsten lamp. The sample all gave a clear image having an excellent resolution and satisfactory gradation reproducibility.

EXAMPLE 2

By using the preparation device shown in FIG. 17, samples of image forming members for electrophotography (Sample Nos. 21-1A to 27-3A, Table 4A) were prepared on a cylindrical aluminum substrate under the condition shown in Table 3A.

The concentration distributions of germanium atoms and oxygen atoms in the sample are shown in FIG. 18, and FIG. 19, respectively.

Each sample was subjected to image quality evaluation test in the same manner as in Example 1. Every sample tested gave a transferred toner image of high quality, and did not show deterioration in the image quality after 200,000 times of repetitive use under the operation condition of 38° C. and 80% RH.

EXAMPLE 3

Samples of an image forming member for electrophotography (Sample Nos. 11-1-1A to 11-1-8A, 12-1-1A to 12-1-8A, 13-1-1A to 13-1-8A: 24 samples) were prepared under the same conditions and in the same manner as for Sample 11-1A, 12-1A, and 13-1A in Example 1 except that the layer (II) was prepared under the conditions shown in Table 5A.

Each samples thus prepared was set separately on a copying machine and was evaluated generally for quality of transferred image and durability of the member in continuous repetitive copying under the conditions described in the Examples regarding to each of the image forming member for electrophotography.

The evaluation of overall quality of the transferred image and the durability in continuous repetitive copying are shown in Table 6A.

EXAMPLE 4

Image forming members were prepared in the same manner as for Sample No. 11-1A in Example 1 except that the ratio of the content of silicon atoms and carbon atoms in the layer (II) was modified by changing the target area ratio of silicon wafer to graphite in forming the layer (II).

Each of the image forming member thus obtained was tested for the quality of the image formed after the 50,000 repetitions of image forming, developing, and cleaning processes as described in Example 1. The results are shown in Table 7A.

EXAMPLE 5

Each of the image forming members was prepared in the same manner as for the Sample No. 12-1A in Example 1 except that the content ratio of silicon atoms to carbon atoms in the second layer (II) was modified by changing the flow rate ratio of $SiH_4$ gas to $C_2H_4$ gas in forming the second layer (II).

The image forming members thus obtained were evaluated for the image quality after 50,000 repetitions of the copying process including image transfer according to the procedure described in Example 1. The results are shown in Table 8A.

EXAMPLE 6

Each of the image forming members was prepared in the same manner as for the same No. 13-1A in Example 1 except that the content ratio of silicon atoms to carbon atoms in layer (II) was modified by changing the flow rate ratio of $SiH_4$ gas, $SiF_4$ gas, and $C_2H_4$ gas on forming the layer (II).

Each of the image forming members thus obtained was evaluated for the image quality after 50,000 repetitions of the image-forming, developing, and cleaning process according to procedure described in Example 1. The results are shown in Table 9A.

EXAMPLE 7

Each of the image forming members was prepared in the same manner as for the Sample No. 14-1A in Example 1 except that the layer thickness of the layer (II) was changed. After the repetition of image forming, developing, and cleaning process as described in Example 1, the results shown in Table 10A were obtained.

The common conditions of the layer formation in the Examples of the present invention is as below:

Substrate temperature:

approximately 200° C. for the layer containing germanium approximately 250° C. for the layer not containing germanium Discharge frequency: 13.56 MHz Inner pressure of reaction chamber during reaction: 0.3 Torr

EXAMPLE 8

By using the preparation device shown in FIG. 17, samples of image forming members for electrophotography (Sample Nos. 11-1B to 17-3B, Table 2B) were prepared on a cylindrical aluminum substrate under the condition shown in Table 1B.

The concentration distributions of germanium atoms and oxygen atoms in the sample are shown in FIG. 18, and FIG. 19, respectively.

The sample thus prepared was set on an experimental charge-exposure device, and corona charging was effected at ⊕5.0 KV for 0.3 second, followed by immediate irradiation of a light image of a transmissive test chart with a tungsten lamp light at an irradiation dose of 2 lux-sec.

Immediately thereafter, a negatively chargeable developer (containing a toner and a carrier) was cascaded onto the surface of the image forming member, thus giving a good toner image thereon. The toner image was transferred onto a transfer paper by corona charging of ⊕5.0 KV, giving a clear image of high density with excellent resolution and sufficient gradation reproducibility.

The evaluation of quality of the transferred toner image was repeated in the same manner as described above except that semi-conductor laser of GaAs type of 810 nm (10 mW) was used in place of the tungsten lamp. The sample all gave a clear image having an excellent resolution and satisfactory gradation reproducibility.

EXAMPLE 9

By using the preparation device shown in FIG. 17, samples of image forming members for electrophotography (Sample Nos. 21-1B to 27-3B, Table 4B) were prepared on a cylindrical aluminum substrate under the condition shown in Table 3B.

The concentration distributions of germanium atoms and oxygen atoms in the sample are shown in FIG. 18, and FIG. 19, respectively.

Each sample was subjected to image quality evaluation test in the same manner as in Example 8. Every sample tested gave a transferred toner image of high quality, and did not show deterioration in the image quality after 200,000 times of repetitive use under the operation condition of 38° C. and 80% RH.

EXAMPLE 10

Samples of an image forming member for electrophotography (Sample Nos. 11-1-1B to 11-1-8B, 12-1-1B to 12-1-8B, 13-1-1B to 13-1-8B: 24 samples) were prepared under the same conditions and in the same manner as for Sample 11-1B, 12-1B, and 13-1B in Example 8 except that the layer (II) was prepared under the conditions shown in Table 5B.

Each samples thus prepared was set separately on a copying machine and was evaluated generally for quality of transferred image and durability of the member in continuous repetitive copying under the conditions described in the Examples regarding to each of the image forming member for electrophotography.

The evaluation of overall quality of the transferred image and the durability in continuous repetitive copying are shown in Table 6B.

EXAMPLE 11

Image forming members were prepared in the same manner as for Sample No. 11-1B in Example 8 except that the ratio of the content of silicon atoms and nitrogen atoms in the layer (II) was modified by changing the target area ratio of silicon wafer to silicon nitride wafer in forming the layer (II).

Each of the image forming member thus obtained was tested for the quality of the image formed after the 50,000 repetitions of image forming, developing, and cleaning processes as described in Example 8. The results are shown in Table 7B.

EXAMPLE 12

Each of the image forming members was prepared in the same manner as for the Sample No. 12-1B in Example 8 except that the content ratio of silicon atoms to nitrogen atoms in layer (II) was modified by changing the flow rate ratio of $SiH_4$ gas to $NH_3$ gas in forming the layer (II).

The image forming members thus obtained were evaluated for the image quality after 50,000 repetitions of the copying process including image transfer according to the procedure described in Example 8. The results are shown in Table 8B.

EXAMPLE 13

Each of the image forming members was prepared in the same manner as for the Sample No. 13-1B in Example 8 except that the content ratio of silicon atoms to nitrogen atoms in layer (II) was modified by changing the flow rate ratio of $SiH_4$ gas, $SiF_4$ gas, and $C_2H_4$ gas on forming the layer (II).

Each of the image forming members thus obtained was evaluated for the image quality after 50,000 repetitions of the image-forming, developing, and cleaning process according to procedure described in Example 8. The results are shown in Table 9B.

EXAMPLE 14

Each of the image forming members was prepared in the same manner as for the Sample No. 14-1B in Example 8 except that the layer thickness of the layer (II) was changed. After the repetition of image forming, developing, and cleaning process as described in Example 8, the results shown in Table 10B were obtained.

The common conditions of the layer formation in the Examples of the present invention is as below:

Substrate temperature:

approximately 200° C. for the layer containing germanium approximately 250° C. for the layer not containing germanium Discharge frequency: 13.56 MHz Inner pressure of reaction chamber during reaction: 0.3 Torr

TABLE 1A

| Layer constitution | | Gases employed | Flow rate (SCCM) | Flow rate ratio | Discharging power (W/cm²) | Layer formation rate (Å/sec) | Layer thickness (μm) |
|---|---|---|---|---|---|---|---|
| Layer (I) | First layer | $SiH_4$/He = 0.5<br>$GeH_4$/He = 0.5<br>NO | $SiH_4 + GeH_4 = 200$ | — | 0.18 | 15 | 5 |
| | Second layer | $SiH_4$/He = 0.5<br>NO | $SiH_4 = 200$ | — | 0.18 | 15 | 23 |
| Layer (II) | | $SiH_4$/He = 0.5<br>$C_2H_4$ | $SiH_4 = 100$ | $SiH_4/C_2H_4 = 3/7$ | 0.18 | 10 | 0.5 |

TABLE 2A

| Depth profile of O | Sample No. | Depth profile of Ge 1801 | 1802 | 1803 | 1804 | 1805 | 1806 | 1807 |
|---|---|---|---|---|---|---|---|---|
| | 1901 | 11-1A | 12-1A | 13-1A | 14-1A | 15-1A | 16-1A | 17-1A |
| | 1902 | 11-2A | 12-2A | 13-2A | 14-2A | 15-2A | 16-2A | 17-2A |
| | 1903 | 11-3A | 12-3A | 13-3A | 14-3A | 15-3A | 16-3A | 17-3A |

TABLE 3A

| Layer constitution | | Gases employed | Flow rate (SCCM) | Flow rate ratio | Discharging power (W/cm²) | Layer formation rate (Å/sec) | Layer thickness (μm) |
|---|---|---|---|---|---|---|---|
| Layer (I) | First layer | $SiH_4$/He = 0.5<br>$GeH_4$/He = 0.5<br>NO<br>$B_2H_6$/He = $10^{-3}$ | $SiH_4 + GeH_4 = 200$ | — | 0.18 | 15 | 5 |
| | Second layer | $SiH_4$/He = 0.5<br>NO | $SiH_4 = 200$ | — | 0.18 | 15 | 25 |
| Layer (II) | | $SiH_4$/He = 0.5<br>$C_2H_4$ | $SiH_4 = 100$ | $SiH_4/C_2H_4 = 3/7$ | 0.18 | 10 | 0.5 |

TABLE 4A

| Depth profile of O | Sample No. | Depth profile of Ge 1801 | 1802 | 1803 | 1804 | 1805 | 1806 | 1807 |
|---|---|---|---|---|---|---|---|---|
| | 1901 | 21-1A | 22-1A | 23-1A | 24-1A | 25-1A | 26-1A | 27-1A |
| | 1902 | 21-2A | 22-2A | 23-2A | 24-2A | 25-2A | 26-2A | 27-2A |
| | 1903 | 21-3A | 22-3A | 23-3A | 24-3A | 25-3A | 26-3A | 27-3A |

TABLE 5A

| Conditions | Gases employed | Flow rate (SCCM) | Flow rate ratio or Area ratio | Discharging power (W/cm²) | Layer thickness (μ) |
|---|---|---|---|---|---|
| 5-1A | Ar | 200 | Si Wafer:Graphite = 1.5:8.5 | 0.3 | 0.5 |
| 5-2A | Ar | 200 | Si Wafer:Graphite = | 0.3 | 0.3 |

TABLE 5A-continued

| Conditions | Gases employed | Flow rate (SCCM) | Flow rate ratio or Area ratio | Discharging power ($W/cm^2$) | Layer thickness ($\mu$) |
|---|---|---|---|---|---|
| | | | 0.5:9.5 | | |
| 5-3A | Ar | 200 | Si Wafer:Graphite = 6:4 | 0.3 | 1.0 |
| 5-4A | $SiH_4$/He = 1 $C_2H_4$ | $SiH_4$ = 15 | $SiH_4$:$C_2H_4$ = 0.4:9.6 | 0.18 | 0.3 |
| 5-5A | $SiH_4$/He = 0.5 $C_2H_4$ | $SiH_4$ = 100 | $SiH_4$:$C_2H_4$ = 5:5 | 0.18 | 1.5 |
| 5-6A | $SiH_4$/He = 0.5 $SiF_4$/He = 0.5 $C_2H_4$ | $SiH_4$ + $SiF_4$ = 150 | $SiH_4$:$SiF_4$:$C_2H_4$ = 1.5:1.5:7 | 0.18 | 0.5 |
| 5-7A | $SiH_4$/He = 0.5 $SiF_4$/He = 0.5 $C_2H_4$ | $SiH_4$ + $SiF_4$ = 15 | $SiH_4$:$SiF_4$:$C_2H_4$ = 0.3:0.1:9.6 | 0.18 | 0.3 |
| 5-8A | $SiH_4$/He = 0.5 $CiF_4$/He = 0.5 $C_2H_4$ | $SiH_4$ + $SiF_4$ = 150 | $SiH_4$:$SiF_4$:$C_2H_4$ = 3:3:4 | 0.18 | 1.5 |

TABLE 6A

| Layer (II) forming conditions | Sample No./Evaluation | | |
|---|---|---|---|
| 5-1A | 11-1-1A ○ ○ | 12-1-1A ○ ○ | 13-1-1A ○ ○ |
| 5-2A | 11-1-2A ○ ○ | 12-1-2A ○ ○ | 13-1-2A ○ ○ |
| 5-3A | 11-1-3A ○ ○ | 12-1-3A ○ ○ | 13-1-3A ○ ○ |
| 5-4A | 11-1-4A ◎ ◎ | 12-1-4A ◎ ◎ | 13-1-4A ◎ ◎ |
| 5-5A | 11-1-5A ◎ ◎ | 12-1-5A ◎ ◎ | 13-1-5A ◎ ◎ |

TABLE 6A-continued

| | | | |
|---|---|---|---|
| 5-6A | 11-1-6A ◎ ◎ | 12-1-6A ◎ ◎ | 13-1-6A ◎ ◎ |
| 5-7A | 11-1-7A ○ ○ | 12-1-7A ○ ○ | 13-1-7A ○ ○ |
| 5-8A | 11-1-8A ○ ○ | 12-1-8A ○ ○ | 13-1-8A ○ ○ |

Sample No.

Overall image quality evaluation — Durability evaluation

Evaluation standards:
. ◎ Excellent
. ○ Good

TABLE 7A

| Sample No. | 1301A | 1302A | 1303A | 1304A | 1305A | 1306A | 1307A |
|---|---|---|---|---|---|---|---|
| Si:C target (Area ratio) | 9:1 | 6.5:3.5 | 4:6 | 2:8 | 1:9 | 0.5:9.5 | 0.2:9:8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | X |

◎: Very good
○ : Good
Δ: Practically satisfactory
X: Image defect formed

TABLE 8A

| Sample No. | 1401A | 1402A | 1403A | 1404A | 1405A | 1406A | 1407A | 1408A |
|---|---|---|---|---|---|---|---|---|
| $SiH_4$:$C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎: Very good
○ : Good
Δ: Practically satisfactory
X: Image defect formed

TABLE 9A

| Sample No. | 1501A | 1502A | 1503A | 1504A | 1505A | 1506A | 1507A | 1508A |
|---|---|---|---|---|---|---|---|---|
| $SiH_4$:$SiF_4C_2H_4$ (Flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎: Very good
○ : Good
Δ: Practically satisfactory
X: Image defect formed

TABLE 10A

| Sample No. | Thickness of second layer (II) (μ) | Results |
|---|---|---|
| 1601A | 0.001 | Image defect liable to be formed |
| 1602A | 0.02 | No image defect formed up to successive copying for 20,000 times |
| 1603A | 0.05 | Stable up to successive copying for 50,000 times |
| 1604A | 1 | Stable up to successive copying for 200,000 times |

TABLE 1B

| Layer constitution | | Gases employed | Flow rate (SCCM) | Flow rate ratio | Discharging power (W/cm$^2$) | Layer formation rate (Å/sec) | Layer thickness (μm) |
|---|---|---|---|---|---|---|---|
| First Layer (I) | Layer region (G) | $SiH_4$/He = 0.5<br>$GeH_4$/He = 0.5<br>NO | $SiH_4 + GeH_4$ =200 | — | 0.18 | 15 | 5 |
| | Layer region (S) | $SiH_4$/He = 0.5<br>NO | $SiH_4$ = 200 | — | 0.18 | 15 | 23 |
| Second Layer (II) | | $SiH_4$/He = 0.5<br>$NH_3$ | $SiH_4$ = 100 | $SiH_4/NH_3$ = 317 | 0.18 | 10 | 0.5 |

TABLE 2B

| Depth profile of O | Sample No. | Depth profile of Ge | | | | | | |
|---|---|---|---|---|---|---|---|---|
| | | 1801 | 1802 | 1803 | 1804 | 1805 | 1806 | 1807 |
| | 1901 | 11-1B | 12-1B | 13-1B | 14-1B | 15-1B | 16-1B | 17-1B |
| | 1902 | 11-2B | 12-2B | 13-2B | 14-2B | 15-2B | 16-2B | 17-2B |
| | 1903 | 11-3B | 12-3B | 13-3B | 14-3B | 15-3B | 16-3B | 17-3B |

TABLE 3B

| Layer constitution | | Gases employed | Flow rate (SCCM) | Flow rate ratio | Discharging power (W/cm$^2$) | Layer formation rate (Å/sec) | Layer thickness (μm) |
|---|---|---|---|---|---|---|---|
| First Layer (I) | Layer region (G) | $SiH_4$/He = 0.5<br>$GeH_4$/He = 0.5<br>NO<br>$B_2H_6$/He = $10^{-3}$ | $SiH_4 + GeH_4$ = 200 | — | 0.18 | 15 | 3 |
| | Layer region (S) | $SiH_4$/He = 0.5<br>NO | $SiH_4$ = 200 | — | 0.18 | 15 | 25 |
| Second Layer (II) | | $SiH_4$/He = 0.5<br>$NH_3$ | $SiH_4$ = 100 | $SiH_4/NH_3$ = 317 | 0.18 | 10 | 0.5 |

TABLE 4B

| Depth profile of O | Sample No. | Depth profile of Ge | | | | | | |
|---|---|---|---|---|---|---|---|---|
| | | 1801 | 1802 | 1803 | 1804 | 1805 | 1806 | 1807 |
| | 1901 | 21-1B | 22-1B | 23-1B | 24-1B | 25-1B | 26-1B | 27-1B |
| | 1902 | 21-2B | 22-2B | 23-2B | 24-2B | 25-2B | 26-2B | 27-2B |
| | 1903 | 21-3B | 22-3B | 23-3B | 24-3B | 25-3B | 26-3B | 27-3B |

TABLE 5B

| Conditions | Gases employed | Flow rate (SCCM) | Flow rate ratio or Area ratio | Discharging power (W/cm$^2$) | Layer thickness (μ) |
|---|---|---|---|---|---|
| 5-1B | Ar | 200 | Si Wafer:Silicon nitride = 1:30 | 0.3 | 0.5 |
| 5-2B | Ar | 200 | Si Wafer:Silicon nitride = 1:60 | 0.3 | 0.3 |
| 5-3B | Ar | 200 | Si Wafer:Silicon nitride = 6:4 | 0.3 | 1.0 |
| 5-4B | $SiH_4$/He = 1<br>$NH_3$ | $SiH_4$ = 15 | $SiH_4:NH_3$ = 1:100 | 0.18 | 0.3 |
| 5-5B | $SiH_4$/He = 0.5<br>$NH_3$ | $SiH_4$ = 100 | $SiH_4:NH_3$ = 1:30 | 0.18 | 1.5 |
| 5-6B | $SiH_4$/He = 0.5<br>$SiF_4$/He = 0.5<br>$NH_3$ | $SiH_4 + SiF_4$ = 150 | $SiH_4:SiF_4:NH_3$ = 1:1:60 | 0.18 | 0.5 |

TABLE 5B-continued

| Conditions | Gases employed | Flow rate (SCCM) | Flow rate ratio or Area ratio | Discharging power ($W/cm^2$) | Layer thickness ($\mu$) |
|---|---|---|---|---|---|
| 5-7B | $SiH_4$/He = 0.5<br>$SiF_4$/He = 0.5<br>$NH_3$ | $SiH_4 + SiF_4 = 15$ | $SiH_4:SiF_4:NH_3$ = 2:1:90 | 0.18 | 0.3 |
| 5-8B | $SiH_4$/He = 0.5<br>$SiF_4$/He = 0.5 | $SiH_4 + SiF_4 = 150$ | $SiH_4:SiF_4:NH_3$ = 1:1:20 | 0.18 | 1.5 |

TABLE 6B

| Layer (II) forming conditions | Sample No./Evaluation | | |
|---|---|---|---|
| 5-1B | 11-1-1B<br>○ ○ | 12-1-1B<br>○ ○ | 13-1-1B<br>○ ○ |
| 5-2B | 11-1-2B<br>○ ○ | 12-1-2B<br>○ ○ | 13-1-2B<br>○ ○ |
| 5-3B | 11-1-3B<br>○ ○ | 12-1-3B<br>○ ○ | 13-1-3B<br>○ ○ |
| 5-4B | 11-1-4B<br>◎ ◎ | 12-1-4B<br>◎ ◎ | 13-1-4B<br>◎ ◎ |
| 5-5B | 11-1-5B<br>◎ ◎ | 12-1-5B<br>◎ ◎ | 13-1-5B<br>◎ ◎ |
| 5-6B | 11-1-6B<br>◎ ◎ | 12-1-6B<br>◎ ◎ | 13-1-6B<br>◎ ◎ |
| 5-7B | 11-1-7B<br>○ ○ | 12-1-7B<br>○ ○ | 13-1-7B<br>○ ○ |
| 5-8B | 11-1-8B<br>○ ○ | 12-1-8B<br>○ ○ | 13-1-8B<br>○ ○ |
| | Sample No. | | |
| Overall image | Durability evaluation | | |

TABLE 6B-continued quality evaluation
Evaluation standards:
◎ Excellent
○ Good

TABLE 7B

| Sample No. | 1301B | 1302B | 1303B | 1304B | 1305B | 1306B | 1307B |
|---|---|---|---|---|---|---|---|
| $Si:Si_3N_4$ target (Area ratio) | 9:1 | 6.5:3.5 | 4:10 | 2:60 | 1:100 | 1:100 | 1:100 |
| Si:N (content ratio) | 9.7:0.3 | 8.8:1.2 | 7.3:2.7 | 5.0:5.0 | 4.5:5.5 | 4:6 | 3:7 |
| Image quality evaluation | Δ | ○ | ◎ | ◎ | ○ | Δ | X |

◎: Very good
○: Good
Δ: Practically satisfactory
X: Image defect formed

TABLE 8B

| Sample No. | 1401B | 1402B | 1403B | 1404B | 1405B | 1406B | 1407B | 1408B |
|---|---|---|---|---|---|---|---|---|
| $SiH_4:NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 5:5 | 4.5:5.5 | 4:6 | 3.5:6.5 |
| Image quality evaluation | Δ | ○ | ◎ | ◎ | ◎ | ○ | Δ | X |

◎: Very good
○: Good
Δ: Practically satisfactory
X: Image defect formed

TABLE 9B

| Sample No. | 1501B | 1502B | 1503B | 1504B | 1505B | 1506B | 1507B | 1508B |
|---|---|---|---|---|---|---|---|---|
| $SiH_4:SiF_4:NH_3$ (Flow rate ratio) | 5:4:1 | 1:1:6 | 1:1:20 | 1:1:60 | 1:2:300 | 2:1:3000 | 1:1:10000 | 1:1:20000 |
| Si:N (content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | ○ | ◎ | ◎ | ◎ | ○ | Δ | X |

◎: Very good
○: Good
Δ: Practically satisfactory
X: Image defect formed

TABLE 10B

| Sample No. | Thickness of second layer (II) ($\mu$) | Results |
|---|---|---|
| 1601B | 0.001 | Image defect liable to be formed |
| 1602B | 0.02 | No image defect formed up to successive copying for 20,000 times |
| 1603B | 0.05 | Stable up to successive copying for 50,000 times |
| 1604B | 1 | Stable up to successive copying for 200,000 times |

We claim:

1. A photoconductive member, having a substrate for photoconductive member, and a light receiving layer comprising (1) a first layer with a layer constitution in which a first layer region (G) comprising an amorphous material containing germanium atoms and a second layer region (S) exhibiting photoconductivity comprising an amorphous material containing silicon atoms are successively provided on said substrate from the aforesaid substrate side, and (2) a second layer comprising an amorphous material containing silicon atoms and at least one of carbon atoms and nitrogen atoms, said first layer having a layer region (O) containing oxygen atoms, comprising a zone wherein the depth profile of oxygen atoms in the layer thickness direction in said layer region (O) is increased smoothly and continuously toward the upper end surface of the first layer.

2. A photoconductive member according to claim 1, wherein hydrogen atoms are contained in at least one of the first layer region (G) and the second layer region (S).

3. A photoconductive member according to claim 1, wherein halogen atoms are contained at least one of the first layer region (G) and the second layer region (S).

4. A photoconductive member according to claim 1, wherein the germanium atoms are distributed in the layer region (G) ununiformly in the layer thickness direction.

5. A photoconductive member according to claim 1, wherein the germanium atoms are distributed in the layer region (G) uniformly in the layer thickness direction.

6. A photocondutive member according to claim 1, wherein the substance (C) for controlling conductivity is contained in the light receiving layer.

7. A photoconductive member according to claim 6, wherein the substance (C) for controlling conductivity is an atom belonging to the group III of the periodic table.

8. A photoconductive member according to claim 6, wherein the substance (C) for controlling conductivity is an atom belonging to the group V of the periodic table.

9. A photoconductive member according to claim 1, wherein silicon atoms are contained in the first layer region (G).

10. A photoconductive member according to claim 1, wherein the amount of germanium atoms contained in the first layer region (G) is in the range of from 1 to $1\times10^6$ atomic ppm.

11. A photoconductive member according to claim 1, wherein the first layer region (G) has a layer thickness ranging from 30 Å to 50μ.

12. A photoconductive member according to claim 1, wherein the second layer region (S) has a layer thickness ranging from 0.5 to 90μ.

13. A photoconductive member according to claim 1, wherein the layer thickness $T_B$ of the first layer region (G) and the layer thickness T of the second layer region (S) satisfy the relation of $T_B/T \leqq 1$.

14. A photoconductive member according to claim 3, wherein halogen atoms are selected from the group consisting of fluorine, chlorine, bromine and iodine.

15. A photoconductive member according to claim 1, wherein the content of oxygen atoms in the layer region (O) is in the range of from 0.001 to 50 atomic %.

16. A photoconductive member according to claim 1, wherein the upper limit of the content of the oxygen atoms in said layer region (O) is not more than 30 atomic %, when the layer thickness $T_O$ of the layer region (O) containing oxygen atoms comprises 2/5 or more of the layer thickness T of the light-receiving layer.

17. A photoconductive member according to claim 1, wherein 0.01 to 40 atomic % of hydrogen atoms are contained in the first layer region (G).

18. A photoconductive member according to claim 1, wherein 0.01 to 40 atomic % of halogen atoms are contained in the first layer region (G).

19. A photoconductive member according to claim 1, wherein 0.01 to 40 atomic % as the total of hydrogen atoms and halogen atoms are contained in the first layer region (G).

20. A photoconductive member according to claim 1, wherein 1 to 40 atomic % of hydrogen atoms are contained in the second layer region (S).

21. A photoconductive member according to claim 1, wherein 1 to 40 atomic % of halogen atoms are contained in the second layer region (S).

22. A photoconductive member according to claim 1, wherein 1 to 40 atomic % as the total of hydrogen atoms and halogen atoms are contained in the second layer region (S).

23. A photoconductive member according to claim 7, wherein the atom belonging to the group III of the periodic table is selected from the group consisting of B, Al, Ba, In and Tl.

24. A photoconductive member according to claim 8, wherein the atom belonging to the group V of the periodic table is selected from the group consisting of P, As, Sb and Bi.

25. A photoconductive member according to claim 1, wherein the first layer has a layer region (PN) containing a substance (C) for controlling conductivity on the substrate side.

26. A photoconductive member according to claim 25, wherein the content of the substance (C) for controlling conductivity in the layer region (PN) is in the range of from 0.01 to $5\times10^4$ atomic ppm.

27. A photoconductive member according to claim 25, wherein the content of the substance (C) in the layer region (PN) is 30 atomic ppm or more.

28. A photoconductive member according to claim 1, wherein the first layer has a depletion layer.

29. A photoconductive member according to claim 1, wherein the amorphous material constituting the second layer (II) is an amorphous material represented by the following formula:

$$a-(Si_xC_{1-x})_y(H,X)_{1-y}$$

(where $0<x$, $y<1$, X is a halogen atom).

30. A photoconductive member according to claim 1, wherein the amorphous material constituting the second layer (II) is an amorphous material represented by the following formula:

$$a-(Si_xN_{1-x})_y(H,X)_{1-y}$$

(where $0<x$, $y<1$, X is a halogen atom).

31. A photoconductive member according to claim 1, wherein the second layer (II) has a layer thickness ranging from 0.003 to 30μ.

32. An electrophotographic process which comprises:

(a) applying a charging treatment to a photoconductive member, and a light receiving layer comprising (1) a first layer with a layer constitution in which a first layer region (G) comprising an amorphous material containing germanium atoms and a second layer region (S) exhibiting photoconductivity comprising an amorphous material containing silicon atoms are successively provided on said substrate from the aforesaid substrate side, and (2) a second layer comprising an amorphous material containing silicon atoms and at least one of carbon atoms and nitrogen atoms, said first layer having a layer region (O) containing oxygen atoms, comprising a zone wherein the depth profile of oxygen atoms in the layer thickness direction in said layer region (O) is increased smoothly and continuously toward the upper end surface of the first layer; and (b) irradiating said photoconductive member with an electromagnetic wave carrying information, thereby forming an electrostatic image.

* * * * *